US005130703A

United States Patent [19]

Fairbanks et al.

[11] Patent Number: 5,130,703

[45] Date of Patent: Jul. 14, 1992

[54] POWER SYSTEM AND SCAN METHOD FOR LIQUID CRYSTAL DISPLAY

[75] Inventors: John P. Fairbanks, Sunnyvale; Andy C. Yuan, Saratoga; Lance T. Klinger, Mountain View, all of Calif.

[73] Assignee: Poqet Computer Corp., Sunnyvale, Calif.

[21] Appl. No.: 374,340

[22] Filed: Jun. 30, 1989

[51] Int. Cl.[5] ..... G09G 3/36

[52] U.S. Cl. ..... 340/784; 340/811

[58] Field of Search ..... 340/718, 719, 765, 784, 340/811, 813, 814, 805; 358/230, 236, 241; 350/332, 333

[56] References Cited

U.S. PATENT DOCUMENTS

| | | | |
|---|---|---|---|
| 3,835,463 | 9/1974 | Tsukamoto et al. . | |
| 4,100,540 | 7/1978 | Fujita et al. . | |
| 4,110,967 | 9/1978 | Fujita . | |
| 4,150,361 | 4/1979 | Yoshida . | |
| 4,186,395 | 1/1980 | Fujita et al. . | |
| 4,231,035 | 10/1980 | Van Doorn et al. . | |
| 4,459,651 | 7/1984 | Fenter . | |
| 4,496,219 | 1/9185 | Altman . | |
| 4,499,458 | 2/1985 | Le Berre et al. . | |
| 4,571,585 | 2/1986 | Stein et al. . | |
| 4,635,127 | 1/1987 | Togashi | 358/236 |
| 4,707,692 | 11/1987 | Higgins et al. | 340/805 |
| 4,842,371 | 6/1989 | Yasuda et al. | 340/765 |
| 4,893,117 | 1/1990 | Blomley et al. | 340/811 |
| 4,909,607 | 3/1990 | Ross | 340/811 |
| 4,922,240 | 5/1990 | Duwaer | 340/719 |
| 4,922,243 | 5/1990 | Kozicki et al. | 340/811 |

OTHER PUBLICATIONS

Alt, Paul M., "Scanning Limitations of Liquid-Crystal Displays," *IEEE Transactions on Electron Devices*, vol. Ed.-21, No. 2, pp. 146-155, Feb. 1974.

Hughes, J. R., "Contrast Variations in High-Level Multiplexed Twisted Nematic Liquid-Crystal Displays," *IEEE Proceedings*, vol. 133, Pt. I, No. 4, pp. 145-151, Aug. 1986.

*Primary Examiner*—Jeffery A. Brier

*Attorney, Agent, or Firm*—Skjerven, Morrill, MacPherson, Franklin & Friel

[57] ABSTRACT

A structure and method for controlling a liquid crystal display takes advantage of the sharp reflectance change over a small voltage change for new liquid crystal display materials, applying ON and OFF pixel voltages very close to the transition voltage of the liquid crystal material and regulating the applied voltage to remain reliably near and on the desired side of this transition voltage. Also, a net zero DC voltage across pixels of the crystal is maintained using a switching mode close to half the frequency of prior art modes. Driving voltages are provided by a switching regulator rather than the prior art voltage divider, resulting in a significant reduction in operating power. The preferred switching regulator generates only three additional voltages for driving rows and columns of the display, in contrast to the five generated voltages of the prior art voltage divider.

An on/off voltage regulator alternately provides or does not provide power to a primary coil, thereby controlling voltage across capacitors associated with secondary coils. This gives accurate voltage control over a wide range of display loads. This voltage regulator is controlled preferably by the low voltage applied across pixels during the time when the pixels are not in the selected row, that is, during the time when the logic state of a pixel is not provided to the pixel.

49 Claims, 26 Drawing Sheets

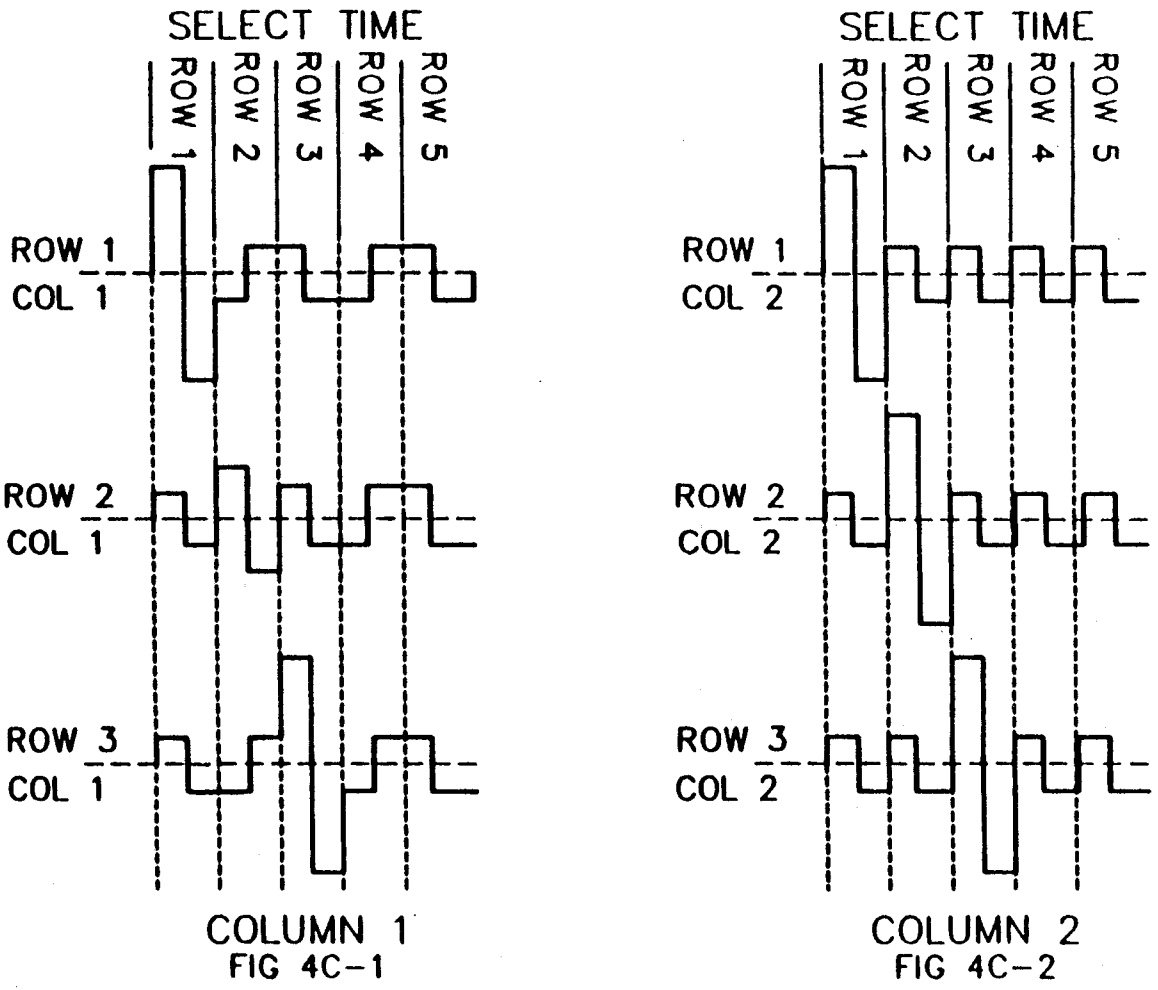
FIG 4C PRIOR ART
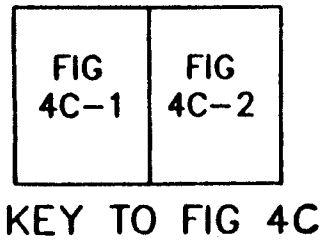
KEY TO FIG 4C

KEY TO FIG 5C

KEY TO FIG 9

POWER SYSTEM AND SCAN METHOD FOR LIQUID CRYSTAL DISPLAY

FIELD OF THE INVENTION

The invention relates to liquid crystal displays, more particularly to generating voltages for driving the pixels in the display.

BACKGROUND

Liquid crystal displays have the advantage of requiring less power than cathode ray tubes or arrays of light emitting diodes. Therefore liquid crystal displays have become popular for use when low power is important. Since low power is a desirable parameter, a further reduction in power required to operate a liquid crystal display is also desirable.

A liquid crystal display is divided into separate picture elements or pixels each of which can be separately controlled to present an ON color or an OFF color. These separate pixels are often arranged in a rectangular array, as shown for example in FIG. 1. A first voltage is applied by a row driver to one side of the liquid crystal material forming the pixel and a second voltage is applied by a column driver to the other side of the liquid crystal material forming the pixel. As shown in FIG. 1 in exploded view, parallel rows 1 through n of conductive lines Rl through Rn are driven from row drivers RDl through RDn (not shown). These row conductive lines are located adjacent to one face of liquid crystal LQll. Parallel columns l through m of conductive lines Cl through Cm are located adjacent to the other face of liquid crystal LQll. Liquid crystal LQll comprises pixels Pl,l through Pm,n arranged in a rectangular array. The numbering system used here identifies a pixel by the number of the row above it and the column below it. Thus pixel P3,2 is between lines R3 and C2. The liquid crystal material of the pixel responds to the integrated RMS voltage difference between its row and column lines by becoming absorbent at voltages on one side of a transition voltage and transmissive at voltages on the other side of the transition voltage.

The earliest liquid crystal displays used a control system which simply applied a first voltage across a pixel to produce the ON color and a second voltage across the pixel to produce the OFF color. More recently, the control has been multiplexed so that the control voltage to any one pixel was applied only part of the time, a background voltage being applied for the remainder of the time. Multiplexing requires more complex control methods in which more than two control voltages are generated.

Until recently, the twisted nematic material of the liquid crystal required a voltage difference on the order of 10–15% to achieve good contrast between the ON state and the OFF state. FIG. 2 shows a comparison between optical and voltage characteristics of older and newer materials, the newer materials showing a change in reflectivity over almost the full range within a voltage range of 5–10% of the total voltage, or within a voltage difference of some 0.1 to 0.2 volts in a system using liquid crystal material with a 2 volt threshold. The OFF voltage is maintained just below the highest voltage at which the appearance of the crystal is acceptably OFF. This is called the threshold voltage. The ON voltage is maintained at slightly more than the voltage at which the appearance of the crystal is acceptably ON. The difference between the ON and OFF voltages is called the transition voltage. The new materials have a transition voltage as low as 5% of the threshold voltage. This new material is 180° to 270° twisted nematic liquid crystal material and is available from Hoffman LaRoche. Because the newer material is so sensitive, it is possible to adequately control a pixel of a display by applying a signal with a duty cycle as small as 1/256. That is, a single column driver can serially control as many as 256 pixels in one column.

Liquid crystal displays are typically driven by selecting a particular row of pixels and activating all columns in that row simultaneously. Such a system was developed as a result of studies by P. Alt & P. Pleshko, described in a paper entitled "Scanning Limitations of Liquid Crystal Displays", IEEE Trans. Electron Devices, Vol. ED-21, No. 2, PP 146–155, 1974, which is incorporated herein by reference. A display having 640 columns and 200 rows can be driven by applying a high voltage row select signal to each pixel in the display 1/200 of the time. The other 199/200 of the time, each pixel sees a bias voltage of slightly less than the threshold voltage. Displays having more than 256 rows can be driven by dividing the display into portions and driving each portion separately, to avoid having a duty cycle lower than 1/256. However, dividing into portions requires providing additional overhead circuitry for driving the additional portions, with consequent increased cost and power usage.

Liquid crystal material must be driven with a net DC voltage of zero in order not to damage the crystal. Various methods have been used to reverse polarity of the voltage in order to achieve a net DC voltage of zero. In one method, the entire frame of the display is scanned applying voltage of one polarity, then the polarity is reversed for an identical scan.

FIG. 3 shows a timing diagram for a portion of a display driven by this method. The voltages applied by the row 2 driver and column 1 driver during the row 2 select time (row 2 is selected) and during other nearby times (the row 1, row 3–5, and row n select times, where n is the last row) are shown. Two sections of the timing diagram are shown in order to demonstrate phase 1 and phase 2. During phase 2 the information of phase 1 is repeated but in opposite polarity, in order to achieve the resultant DC voltage to the pixels of zero. As shown in FIG. 3, during phase 1 for the row 1 select time, the row 2 driver applies an "unselected" voltage of V4, in one embodiment −14.4 volts. At row 2 select time the row 2 driver applies a voltage of V0, in this embodiment 0 volts. For row 3 select time to row n select time the voltage applied by the row 2 driver is again V4. The system then moves to phase 2. During row 1 select time, the row 2 driver applies a voltage V1, in this embodiment −1.6 volts. At row 2 select time the row 2 driver applies a voltage of V5, in this embodiment −16 volts. Subsequently the row 2 driver returns to V1 or −1.6 volts for the remainder of phase 2.

During phase 1, the column 1 driver applies a voltage V3 or V5, which is 1.6 volts either side of the V4 voltage applied by the row drivers when not selected. Thus when not selected a pixel receives the 1.6-volt difference. When selected, which in FIG. 3 for row 2 is during the row 2 select time, the pixel sees a larger voltage difference between its row line and its column line, in the above example 16 volts for an ON pixel. During phase 2, for this ON pixel, row 2 sees a voltage of −1.6 volts when not selected and −16 volts when selected.

The column 1 driver applies voltages of 0 or −3.2 volts during phase 2 depending on the intended state of pixels in column 1. The voltage waveform experienced by the pixel in row 2 column 1 is also shown in FIG. 3. The pixel in row 2 column 1 sees a voltage difference of +1.6 or −1.6 volts when not selected and, because it is to be an ON pixel, +16 or −16 volts when selected. Since the polarity of all voltages experienced by the pixels is reversed during phase 2, net DC voltage is approximately zero. Thus, this method is satisfactory for maintaining the life of the crystal. However, the current to the display drivers, which depends on the frequency of voltage reversal of both row and column drivers, can vary over a tremendously wide range. Displays are scanned a minimum of 50 times (25 pairs) per second to avoid any flicker visible to the human eye. Therefore frequency of voltage reversal cycles can vary from a low of 25 Hz in the case when all pixels are the same color to a high of 5,000 Hz in the case of a checkerboard pattern where phase reversal in one column occurs every pixel for 200 rows. Such a 200:1 frequency variation and therefore current variation has resulted in an inefficient driving mechanism. The difference in polarity reversal frequency seen by the pixels may also reduce the contrast of the display, as will be discussed later. This reduced contrast is most commonly caused by a change in RMS voltage seen by the pixels caused by the fact that the rounded corners of the square wave representing pixel voltage contribute to reducing the RMS voltage more at high frequencies than at low frequencies. The threshold voltage of the crystal increases somewhat with frequency, thereby causing further reduced contrast due to difference in polarity reversal frequency seen by different pixels.

For a battery driven circuit, the single DC voltage of the battery must be converted to a plurality of voltages to drive the multiplexing circuits which control the display. A switching regulator is frequently used for this purpose. FIG. 6 shows such a prior art switching regulator combined with a voltage divider chain with operational amplifiers. The battery provides the voltage difference between Vcc and ground. A first end of a primary coil P61 is connected to one terminal, in this case Vcc, of the battery. The other end of primary coil P61 is connected through switching transistor T61 to ground (the other terminal of the battery). Power delivered by the battery is determined by controlling the on-time of switching transistor T61. A higher on-time produces a higher peak current through primary P61 and a corresponding higher delivery of power to secondary coil S61. Diode D61 and capacitor C61 form a loop with secondary S61. When secondary S61 is driven in a first direction, current flows through diode D61 and charge builds on capacitor C61. When secondary S61 is driven in the opposite direction, current can not flow through diode D61, so built up charge remains on capacitor C61. Thus capacitor C61 supplies a voltage for in turn generating multiple voltages, in this case six voltages, which supply multiplexing circuits M6 for controlling a liquid crystal display.

Typical voltages used to drive the multiplexing circuits are, for example, 0 volts, 1.6 volts, 3.2 volts, 12.8 volts, 14.4 volts, and 16 volts. These six voltages can provide a high voltage difference (16 volts) for driving a selected row line and a low voltage difference for applying data to columns. These six voltages allow a voltage difference of +/−1.6 volts to be applied to each column in each unselected row while for the selected row they allow a voltage difference of 12.8 volts to be applied to all OFF pixels and 16 volts to be applied to all ON pixels. A resultant zero DC voltage across each pixel is also provided. The circuit of FIG. 6 can provide the above set of voltages by providing resistors R62 through R66 proportional to the desired voltage differences, as is well known. Charge proportional to the values of resistors R62 through R66 are stored on capacitors C62 through C66 respectively.

To avoid drawing current high enough to alter the relative voltages on the capacitors, operational amplifiers OA62 through OA65 receive the voltage present on plates of capacitors C62 through C65 respectively, and provide amplified output signals having voltages V1 through V4. An operational amplifier may also amplify the current drawn from the low voltage plate of capacitor C66 and provide the amplified signal on V5. Alternatively, as shown in FIG. 6, follower transistor T66 provides a voltage on line V5 higher by the base-emitter voltage drop of transistor T66 than the variable voltage level of resistor R67.

This voltage divider operational amplifier chain is not efficient in use of power. In the FIG. 6 example, to generate a 1.6 volt output pulse from one of the operational amplifiers requires sourcing current to drive the operational amplifier from a 16-volt supply. Thus the operational amplifiers dissipate considerable power. One voltage divider chain typically requires 30–300 milliwatts of power, which in a typical 200 to 1 multiplexed display is 10 to 100 times that actually needed by the capacitive load of the display.

The circuit of FIG. 6 can supply the six voltage levels shown in FIG. 3. Using the method of FIG. 3, the pixels will receive an average DC voltage close to zero. Because resistors determine the relative voltages, the variation in resistance values causes the net DC current to vary somewhat from zero and thus shorten the life of the liquid crystal.

As shown in FIGS. 4*a*–4*c*, another method of driving the display described by J. R. Hughes, in a paper entitled "Contrast Variations in High-Level Multiplexed Twisted Nematic Liquid-Crystal Displays", IEE Proceedings, Vol. 133, No. 4, August 1986, reverses the polarity of a pulse twice for every row select time so that for the first half of a period in which a row is activated (selected) the voltage applied to a row driver is a first polarity and for the second half of the period the voltage is the opposite polarity. The Hughes paper is incorporated herein by reference. With the Hughes method for scanning a display having 200 rows of pixels at a rate of 50 scans per second, one column driver in a display in which all pixels are one color changes the applied voltage twice per row. As the number of reversals increases the driving frequency decreases. This can be seen by looking at the pixel waveforms in FIGS. 4*a*–4*c*. FIG. 4*a* shows a bit map of a small portion of a display. As shown in FIG. 4*a*, pixels in row 2 col. 1 and row 4 column 1 are to be colored dark (OFF) and other pixels are to be light (ON). Thus the pixels in column 1 are to be of an alternating pattern while the pixels of column 2 are to be of one color. FIG. 4*b* shows the waveforms for rows 1–3 and columns 1–2 of the display. During the first half of row 1 select time, row 1 receives a high voltage, and during the second half of row 1 select time row 1 receives a low voltage. These voltages may be, for example, +14.4 volts and −14.4 volts and may be obtained from the voltage divider circuit of FIG. 6 by appropriately connecting lines V0 through V5 to the display. Row 2 select time is an unselected time for row 1. During unselected times row 1 receives a zero volt signal. During row 2 select time row 2 receives first a high and then a low voltage, and during row 3 select time row 3 also receives first a high and then a low voltage. Each row is thus activated with a high voltage for the first half of the select time followed by a low voltage for the second half of the select time.

To produce an ON pixel at row 1 column 1, during the first half of row 1 select time column 1 presents a low voltage, for example −1.6 volts, and during the second half of row 1 select time column 1 presents a high voltage, for example +1.6 volts. To produce the OFF pixel at row 2 column 1, during row 2 select time, the column 1 driver presents a high voltage followed by a low voltage. To produce the ON pixel in row 3 column 1, at row 3 select time the column 1 driver begins with a low signal and moves to a high signal. The reverse occurs for row 4 and the reverse again occurs for row 5.

As shown in FIG. 4c, there is no change in voltage seen by the pixel in row 1 column 1 between the end of row 2 select time and the beginning of row 3 select time. Likewise, at the transition from row 3 to row 4 and from row 4 to row 5 no voltage change is seen by the pixel in row 1 column 1. The frequency of reversal during this unselected time for the pixel in row 1 column 1 is the same as the frequency of transition from one row time to the next. For the above example, this is 5 kHz.

Column 2 of FIG. 4c is to have all ON pixels. Therefore the column 2 driver provides a low voltage followed by a high voltage for every pixel. Thus the pixels in column 2 see two reversals for every row time. For the above example, the reversal frequency is 10 kHz. The column driver changes voltage at a frequency of 10 kHz while a column driver applying a checkerboard pattern changes voltage at a frequency of 5 kHz. Thus, the Hughes method reversal for a column driver rather than the 200:1 variation of the method of FIG. 3.

Since displays generally do not present a checkerboard pattern but have large areas of one color, a column driver for the Hughes device will on the average operate at a frequency close to this maximum frequency. Current for driving one pixel is determined by the formula $$I=CVF$$

where I is current, C is capacitance of the pixel (the liquid crystal material behaves much like a capacitor as it switches polarity), V is the peak voltage difference across the pixel and F is frequency of the driving voltage. Current for driving the total display is determined by adding current for driving the individual pixels. Therefore for the Hughes method for which frequency is close to 10 kHz the current for driving the device will be consistently at the high end and therefore the device will require fairly high power. For the case of square wave pulses, power follows the formula $$P=CV^2F$$

It is desirable to use a method of driving the device which requires lower current and therefore uses lower power.

In drive methods where frequency of pixel voltage polarity reversal varies by even as much as a 2:1 ratio from one part of an image to another depending upon the pattern, a phenomenon called cross-talk will occur, in which the light background in a solid region directly adjacent a checkerboard patterned region is darker than the background in the checkerboard region. Because the wave form seen by a pixel (see waveforms in FIGS. 3 and 4c, for example) is somewhat rounded at the corners, at a higher frequency the RMS value of voltage seen by the pixel will be somewhat lower than the RMS value at a lower frequency. Since the voltage difference across an ON pixel is only about 5% higher than across an OFF pixel, a 1% variation in RMS voltage is a 20% variation in the voltage difference between ON and OFF, thus the pixel color is extremely sensitive to these small voltage changes. Therefore, it is desirable that frequency of voltage polarity reversal be near constant for all image patterns in order to avoid cross-talk.

SUMMARY OF THE INVENTION

The present invention uses a combination of features to achieve a significant decrease in the power requirement for driving a liquid crystal display and to improve quality of the displayed image. These features include several novel methods for driving the rows and columns of pixels in the display, a novel method for generating the necessary driving voltages, and a novel method for regulating the driving voltages.

All Driving Voltages From 3 Sources

The present invention provides a method of applying column voltages to OFF and ON pixels using only three generated voltages in addition to a reference voltage. Two column voltages are generated, which are intended to have equal magnitude, just as the prior art method provided four voltage sources intended to have equal magnitude. According to the present method, however, any difference between the two column voltages is cancelled by applying the two voltages alternately to the same pixel at different times. These two column voltages are connected to be above and below a common reference point. A single row voltage source has poles alternately connected to this reference point. The pole of one column voltage source not connected to the reference point is connected to column lines where OFF pixels are to be displayed, and the pole of the other column voltage source not connected to the reference point is connected to column lines where ON pixels are to be displayed. For a selected row, the pole of the row voltage source not connected to the reference point is connected to the row line, and for unselected rows, the reference point is connected to the row line. By alternating which pole of the row voltage source is connected to the row line and which to the reference point, and simultaneously alternating which of the column voltage sources supplies ON and OFF pixels, two goals are achieved. Any difference between the magnitude of the two column voltage sources is cancelled because the pixel provides an RMS integration of the applied voltage difference, thus the applied pixel voltage can be tightly regulated with respect to the liquid crystal threshold voltage, and good image quality maintained. Secondly, the difference between the two column voltages, which does produce a non-cancelled d.c. average voltage across the pixels, can be made sufficiently small because the column voltage sources can be secondary windings of a transformer wound together and accurately controlled to be equal. This method of generating three voltages and applying them directly to the pixels without the use of voltage dividers or operational amplifiers produces an order of magnitude power savings for a display having 200 rows.

Phase Reversal Timing for Minimum Variation in Frequency Seen by Pixels and Improved Tracking of Loads Driven by Three Voltage Sources One scan method for driving rows and columns is similar to the Hughes method in that opposite voltages are applied to rows and columns during two halves of each row select time. However, the novelty involves alternating which of the high and low voltages is applied first. Odd rows receive, during the time they are selected, a high voltage driving pulse followed by a low voltage driving pulse, and even rows receive, during the time they are selected, a low voltage driving pulse followed by a high voltage driving pulse. Odd and even may of course be reversed or alternated from one frame scan to the next (a frame is all rows on the display screen). The polarity of column voltages applied during a row time depends on both whether the row is odd or even and whether the pixel is to be ON or OFF. Since a pixel sees the difference between its row and column voltages, if the row select voltage is high during the first half of the select time, and the pixel is to be ON, the column voltage will be low during the first half of the row select time. The next row will have a select voltage which is low during the first half of the select time and high during the second. Thus for an ON pixel in the same column, but next row, the column voltage will be first high and then low. This sequence causes the driving frequency for both rows and columns when the image is a solid color to be half that of the method in which the phase of the driving voltage is switched at both the middle and end of the time the row is selected. For the above example, the present method achieves an average driving frequency closer to half that of the Hughes method and thereby achieves a proportional decrease in driving current, and, importantly, a resultant decrease in power used by the display.

The benefits of this method are that the frequency seen by pixels varies by no more than 2:1, and as ON pixels are added to a largely OFF display there are corresponding increases to current drawn from the row and column voltage sources, so that regulation of the voltages from one of the three sources produces accurate voltages on all three voltage sources.

Phase Reversal Timing for Constant Frequency and Current over Two Frame Scans and Minimum Average Power A second scan method for driving rows and columns provides a switching frequency which is constant when averaged over two frames and thus almost completely avoids frequency-induced cross-talk (in which the light background in a solid region directly adjacent a checkerboard patterned region is darker than the background in the checkerboard region). This second method also draws constant current. According to this second method, the phase is reversed every two rows at the end of a row time and an odd number of rows are provided. When a single pixel has a different color from those around it, the frequency of pixel voltage reversal over a single frame scan is not changed. A checkerboard pattern gives a 90-degree shift but also does not change frequency of pixel voltage reversal over one frame scan. Some random patterns will give a change of frequency over the time span of one frame, but the frequency change over the next frame will be in the opposite direction, giving a resultant constant frequency for any pattern over the span of two frame times. With this method, a data transition from all zeros to all ones on any odd column will subtract one half cycle per frame time and a transition from all zeros to all ones on an even column will add one half cycle per frame time. A single transition of one bit or one row will not affect the average frequency. This is because each row will be scanned an odd number of row times after it was scanned in the previous frame time. Thus for many images, this second method gives excellent image quality. The disadvantage is that the power supply has a much shorter time constant than two frame times, and responds to the frequency of pixel voltage reversal in less than a single frame. For a 20 millisecond frame time, a very low frequency of pixel voltage reversal would alter voltage to the display and reduce display quality. A particular data pattern in which data transitions happened to occur simultaneously with phase reversals could actually produce a frequency of pixel voltage reversals of zero over one frame time or part of a frame time. At zero or very low frequency, the power supply on the column side will have to sink instead of source current in order to maintain a constant voltage. As will be described in detail later, sinking current would require current to flow backward through a diode. Instead, the supply voltage would build up and the preferred voltage would not be maintained. To prevent this undesirable voltage change for certain images requires a load on the column drivers, which is a waste of power if the load accomplishes nothing.

It is possible to use as the column driver supply voltage load the logic for the column drivers, and thereby avoid wasting power, as will be discussed in connection with FIG. 8. When the column logic is used as a load, this every-two-row phase reversal becomes optimum for low power consistent with good image quality.

Phase Reversal Timing for Constant Current and Frequency over Two Frame Scans and Minimum Frequency Which Doesn't Go to Zero over a Time Considerably Shorter Than One Frame Time A third scan method which also achieves constant current and frequency over a span of two frames uses phase reversals 6 times in every 8 rows. Two phase reversals occur in the middle of a row time and four occur at the end of a row time. This third method has the same frequency variation as the second method for single pixel changes, checkerboard, all zeros to all ones, and full rows. Regarding frequency variation over a single frame time, whereas the second method of reversing every two rows can give a frequency variation over a single frame time between 0 and 5 kHz, this third phase reversal timing method, which phase reverses two times in the middle of a row time, and four at the end of a row time will give a frequency variation over a single frame time between 1.25 and 6.25 kHz. Thus power consumption for this third method is somewhat higher than for the second method, but power variation over a short period is not as great as with the second method described earlier, therefore the power supply can maintain voltages more accurately.

If keeping frequency constant over a shorter time interval is important, the first described scan routine is preferred. For example, if the scan is being done at a higher frequency to take advantage of the smaller transition voltage, making the screen more sensitive to frequency change over a short span, the first described scan routine is preferred.

When the column logic is used as a load, the second phase reversal scan method becomes optimum for low power.

When it is not possible to provide a column load, the third method may be preferred.

Voltage Feedback with Good Tracking, Temperature Compensation and Low Power

Using any of the above phase reversal timing techniques, the present invention takes feedback from one of the generated voltages to be applied to the row or column lines and preferably controls the on-time during which the voltage is generated, thereby controlling magnitude of these three generated voltages. With the present invention, each pixel receives a driving pulse to control its state during a small "selected" part of the time, for example if the display includes 200 rows of pixels, during 1/200 of the time. During the remaining "unselected" 199/200 of the time, the pixel receives a constant low voltage (the unselected voltage) having a magnitude near the threshold voltage (the highest voltage at which the display is acceptably OFF), only the polarity and not the amplitude being a function of the state to which another selected pixel in the same column is being driven. When the unselected voltage is used as the voltage to be regulated, the voltage difference applied during the small selected time is integrated by the material of the pixel such that a small change in average RMS voltage caused by applying an OFF signal during the selected time causes the pixel to remain OFF and a larger change in average RMS voltage caused by applying an ON signal causes the pixel to become ON. The low voltage applied during the majority of the time is preferably used for regulating the driving voltages. This is because in a system that is optimized for low power and good contrast the majority of the RMS voltage across the pixel comes from the low voltage supply.

The voltage is preferably fed back to the base of a bipolar transistor which turns on and off an oscillator for generating the voltages. This use of the base-emitter voltage drop of a transistor as a voltage reference has the additional advantage that the base-emitter drop of a bipolar transistor has approximately the same temperature variation as the threshold voltage of liquid crystal material, therefore the transistor inherently provides needed temperature compensation for the display.

Switching regulators regulate best with a fairly constant ratio between currents drawn through various windings driven by the switching regulator. It would not have been possible to use a low cost, single magnetic core switching regulator with one of the prior art methods in which winding current varied by a 200:1 factor for different kinds of images and achieve the same voltage regulation achieved with the method described here. In addition, it would not have been possible to use a switching regulator which generated five additional voltages as done by the described voltage divider chain, because even though the frequency varied by only 2:1, the variation in load to be driven by the five sources would have altered the applied voltages to such an extent that the display quality would have been unacceptable. This effect will be explained in detail in connection with FIG. 7*a*.

In addition to achieving a lower power system, the switching regulator of this invention uses fewer parts than a power supply with a voltage divider and operational amplifiers, and should cost less. In addition, the switching regulator used here is regulated with a feedback voltage signal from the most critical voltage level (the column driver bias voltage) and thus provides more accurate control of RMS average voltage levels across the pixels. Thus the OFF voltage applied to the liquid crystal display pixels can be optimally close to the threshold voltage for good contrast to be maintained. Further, the switching regulator can provide voltages precisely equal in magnitude but opposite in polarity, thus generating voltages seen by the pixels having an integrated DC component quite close to zero. Because current ratios between row and column drivers are nearly constant for most types of images, the display quality is good.

A switching regulator in accordance with the present invention can also be used to produce a power decrease for a method such as shown by Hughes which does not alternate polarity of the row select voltage from one row to the next, as well as for the preferred scan methods described above. However, because with Hughes, a current increase for a row driver is typically accompanied by a current decrease for a column driver, the regulated voltage will be less constant and the image quality will be lower.

BRIEF DESCRIPTION OF THE DRAWINGS

FIGS. 4*a*–4*c* show a pixel pattern to be displayed, a timing diagram for another prior art method of driving a liquid crystal display, and the resultant waveforms seen by six pixels in the display.

DETAILED DESCRIPTION

Figure 5A:
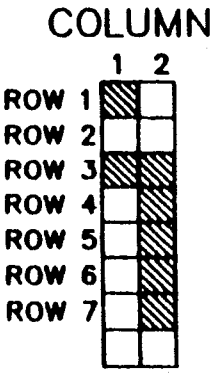
FIGS. 5*a*–5*c* shows a pixel pattern to be displayed, a timing diagram for driving a liquid crystal display according to a first embodiment of the present invention and resulting voltage waveforms seen by six pixels in the display.

As shown in FIG. 5*a*, the intended states of the pixels in row 1 column 1, row 3 column 1 and rows 3–7 column 2 is OFF (black in this embodiment) while the intended states of the other illustrated pixels is ON (white in this embodiment). The state of a pixel is determined by the RMS average of the voltage applied between the row line on one side of the pixel and the column line on the other side of the pixel. A lower RMS voltage must be applied to the pixels in row 1 column 1, row 3 column 1 and rows 3–7 column 2 than to the remaining illustrated pixels. In order to retain long life of the crystal, average DC voltage applied to each pixel in the display must be zero.

Figure 5B:
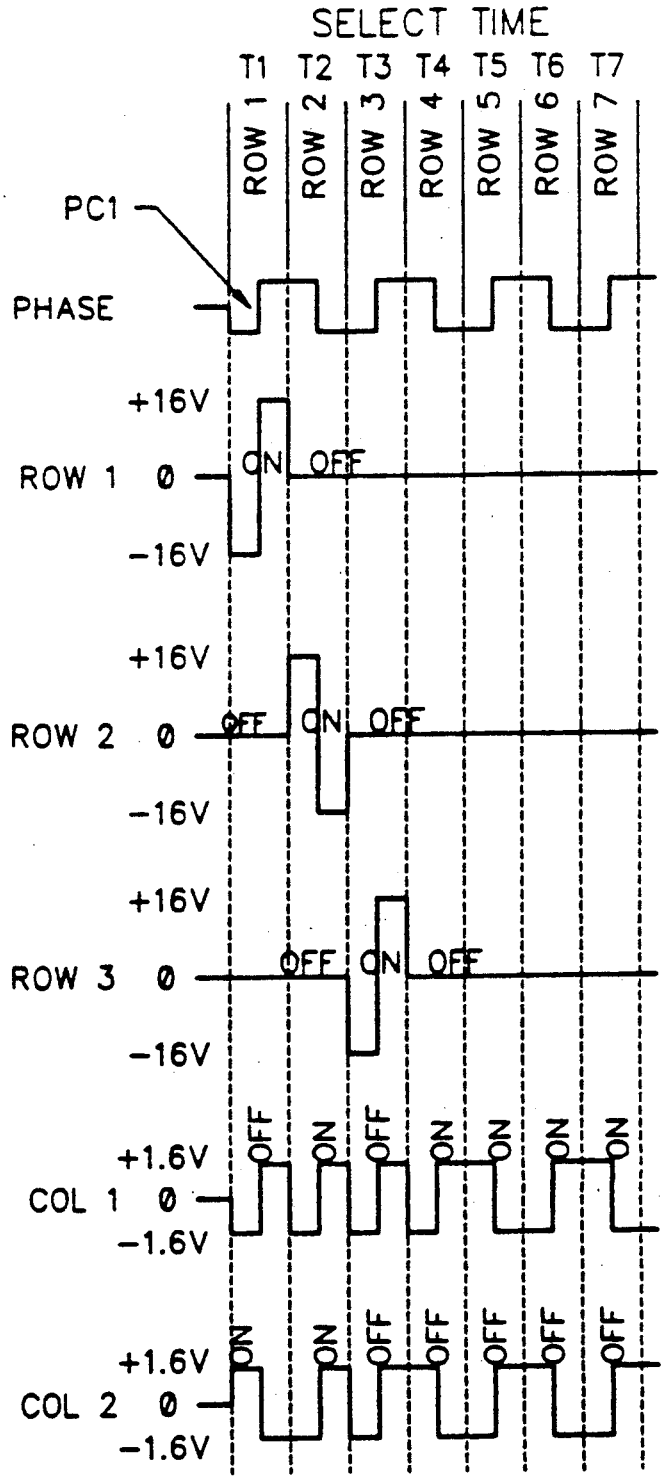

FIG. 5*b* shows waveforms applied to rows 1–3 and columns 1 and 2 during the first seven row select times. During each row select time, voltages of equal magnitude and opposite polarity are alternately applied to each column and each row, the first polarity for the first half of the row select time and the second polarity for the second half of the row select time. Phase clock PC1 determines which polarity of the row select voltages applied to the row lines is applied first during the row select times, the polarity of the row select voltages being equal to the polarity of phase clock PC1. Both phase clock PC1 and the intended states of the pixels determine which polarity of the column voltages is applied first to the column lines.

7 As shown in FIG. 5*b*, during row 1 select time, phase clock PC1 initially presents a low voltage. Midway through row 1 select time, the phase clock PC1 moves to a high voltage. Phase clock PC1 maintains a high voltage during the first half of row 2 select time and then moves to a low voltage for the remainder of row 2 select time. This low signal remains during the first half of row 3 select time. In this way the phase clock PC1 switches at the same frequency as the row select times switch, but 180° out of phase with the switching of row select times. The polarity of the row select voltages is determined by the polarity of the phase clock PC1. Thus, as shown in FIG. 5*b*, during row 1 select time, the row 1 driver applies to row 1 first a low voltage and then a high voltage. The low row 1 select voltage applied during the first half of row 1 select time, as shown in FIG. 5*b* is −16 volts and the high select voltage during the last half of row 1 select time is +16 volts. At the end of row 1 select time and the beginning of row 2 select time, the row 1 driver returns to a voltage of 0 volts. Row 2 is then selected. As determined by the phase clock PC1, which is high at the beginning of row 2 select time, row 2 receives first the high voltage and then the low voltage. During row 3 select time, row 3 receives first the low voltage and then the high voltage, again determined by phase clock PC1.

The column 1 driver applies a data signal during row 1 select time to determine the state of the pixel in row 1 column 1. The intended state of this pixel, as shown in FIG. 5*a*, is OFF. To send an OFF signal, the column 1 driver matches the phase of phase clock PC1, which during row 1 time starts with a low voltage and moves to a high voltage. During row 1 select time, for all columns in row 1 in which an OFF signal is intended, the column driver applies a low signal followed by a high signal. For all columns in row 1 in which an ON signal is intended the column driver applies a high signal followed by a low signal. Thus, since the pixel in row 1, column 2 is to be ON, the column 2 driver during row 1 select time applies a high voltage followed by a low voltage. As shown in the example of FIG. 5*b*, the high column voltage is +1.6 volts and the low column voltage is −1.6 volts.

Figure 5C:
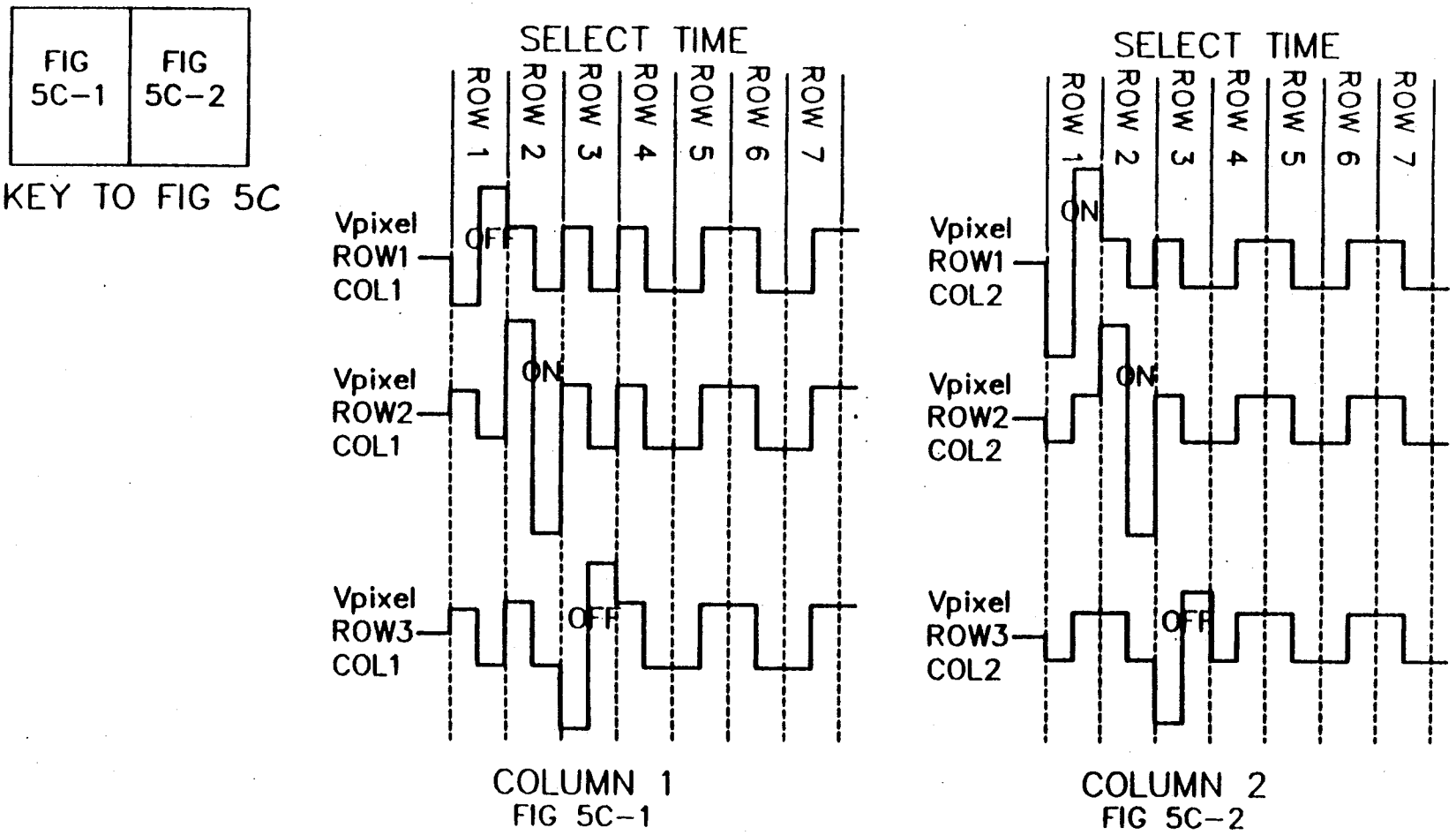

The above combination of signals applied to rows and columns produces pixel voltage waveforms such as shown in FIG. 5*c*. During the first half of row 1 select time, the pixel in row 1 column 1, sees a voltage difference of −16 −(−1.6) or −14.4 volts and during the second half of row 1 select time this pixel sees a voltage difference of +16−1.6 or +14.4 volts. During the unselected remainder of the time the pixel in row 1 column 1 sees a voltage difference of +1.6 volts or −1.6 volts. Only the magnitude and not the polarity of the voltage difference affects the reflectivity state of the pixel. The pixel integrates the successive voltage signals it receives with an RMS formula. Thus the RMS voltage received by the OFF pixel in row 1 column 1, which is determined by the formula $$V_{OFF} = \frac{\sqrt{(1)(VROW - VCOL)^2 + (N-1)(VCOL)^2}}{N}$$

where $V_{OFF}$=the RMS voltage received by an OFF pixel

VROW=magnitude of the row select voltage

VCOL=magnitude of column voltages

N=number of rows in the display produces the following value.

$$V_{OFF} = \frac{\sqrt{(1) \times (14.4^2) + (199) \times (1.6^2)}}{200} = 1.893 \text{ volts}$$

With the new twisted nematic liquid crystal display material, especially the newest 270° twisted nematic material called "double super-twist", the time constant for a pixel to respond to the applied voltage is about 200 milliseconds or about 1/5 second. A typical liquid crystal display for a computer monitor is about 640 columns by 200 rows of pixels. A display is typically scanned positive and negative a minimum of 25 times each per second to avoid flicker. Thus each of the 200 rows is selected for about 1/200×1/50 seconds or about 100 microseconds. For the example mentioned in which the display has 200 rows and each frame is refreshed 50 times per second, or every 20 milliseconds, a pixel requires about 10 frame refreshes to respond, in the above OFF case to show a high absorption.

The pixel in row 2 column 1 is to be an ON pixel. Thus as shown in FIG. 5*b*, the driver of column 1 during row 2 time presents a signal opposite in polarity to phase clock PC1. The column 1 driver applies a low voltage during the first half of row 2 select time and a high voltage during the second half of row 2 select time.

As shown in FIG. 5*c*, the pixel in row 2 column 1 receives during the first half of row 2 select time a voltage of $+16-(-1.6)$ or $+17.6$ volts and during the second half of row 2 select time a voltage of $-16-(+1.6)$ or $-17.6$ volts. This pixel receives during the other 199 row times a voltage of $+1.6$ volts or $-1.6$ volts for an integrated ON voltage, determined by the formula $$V_{ON} = \sqrt{\frac{(1)(VROW + VCOL)^2 + (N-1)(VCOL)^2}{N}}$$

of $$V_{ON} = \sqrt{\frac{(1) \times (17.6^2) + (199) \times (1.6^2)}{200}} = 2.024 \text{ volts}$$

The difference between the integrated RMS voltage of the OFF pixel and the integrated RMS voltage of the ON pixel is thus some 6.9%. With careful regulation of the circuit voltage this small difference is sufficient to produce good contrast between ON and OFF pixels, as indicated by the graph in FIG. 2.

Note that the voltage level applied by a column driver changes mid-way through each row select time. However, the voltage applied by the column driver changes at the end of a row select time only if the state of the next pixel in that column is different. When pixels in adjacent rows of the same column are to have the same state, for example the pixels in column 1 rows 4–7 (see FIG. 5*a*), the signal applied by the driver of column 1 (see FIG. 5*b*) varies at a frequency of only 5 kHz. Likewise the frequency of reversal during unselected times, for example pixels in rows 1–3 column 1 during row times 4–7, is 5 kHz. Since displays usually have fairly continuous portions of one color, the frequency of reversal of the column driver will be closer to 5 kHz than its maximum value of 10 kHz, an important benefit of the present invention.

Figures 1, 8:
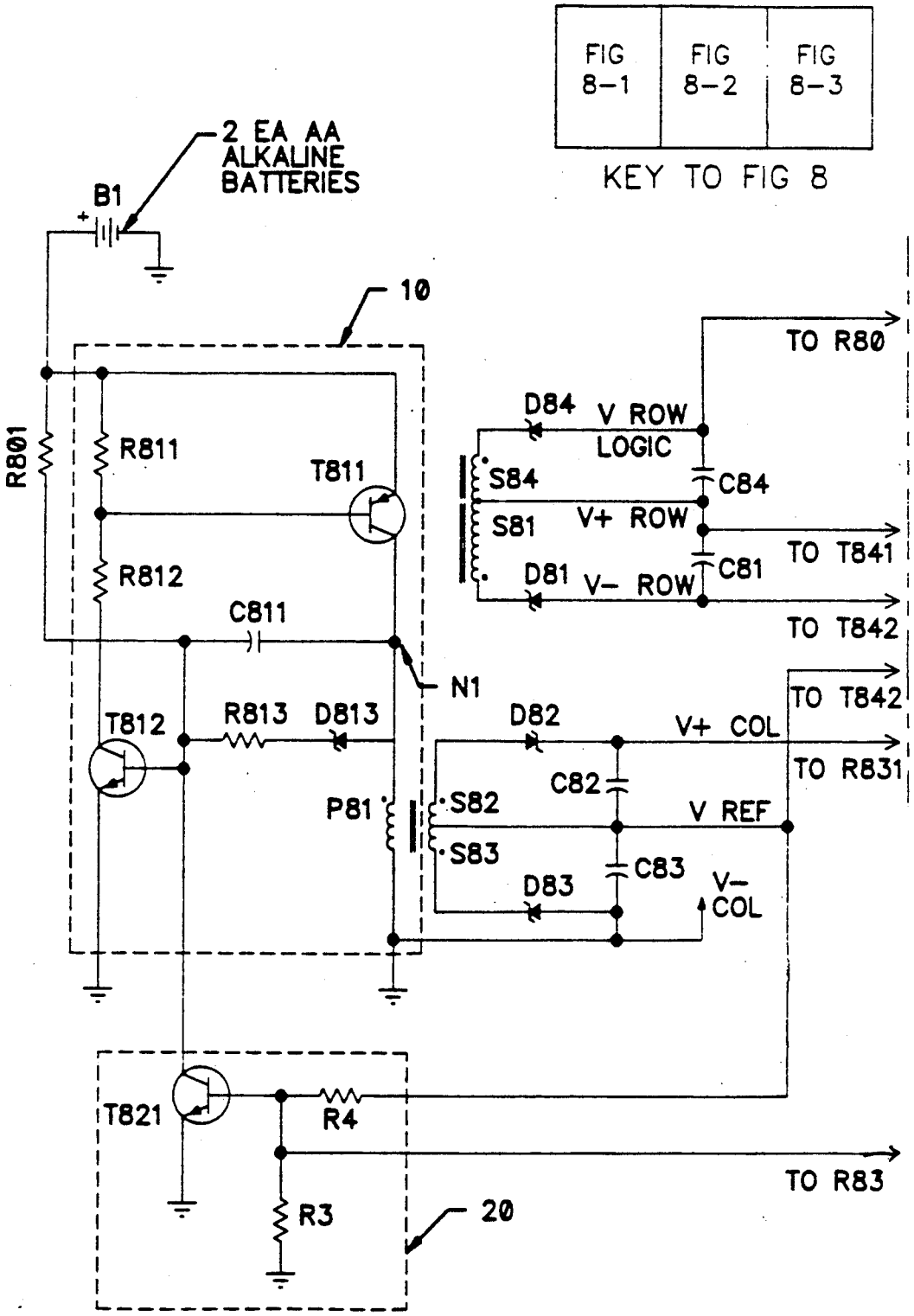
FIG. 8, comprising sections 8-1, 8-2, and 8-3, shows a switching regulator circuit for driving rows and columns according to the present invention in which voltage regulation is based on the voltage difference between a column and an unselected row.
Figures 2, 8:
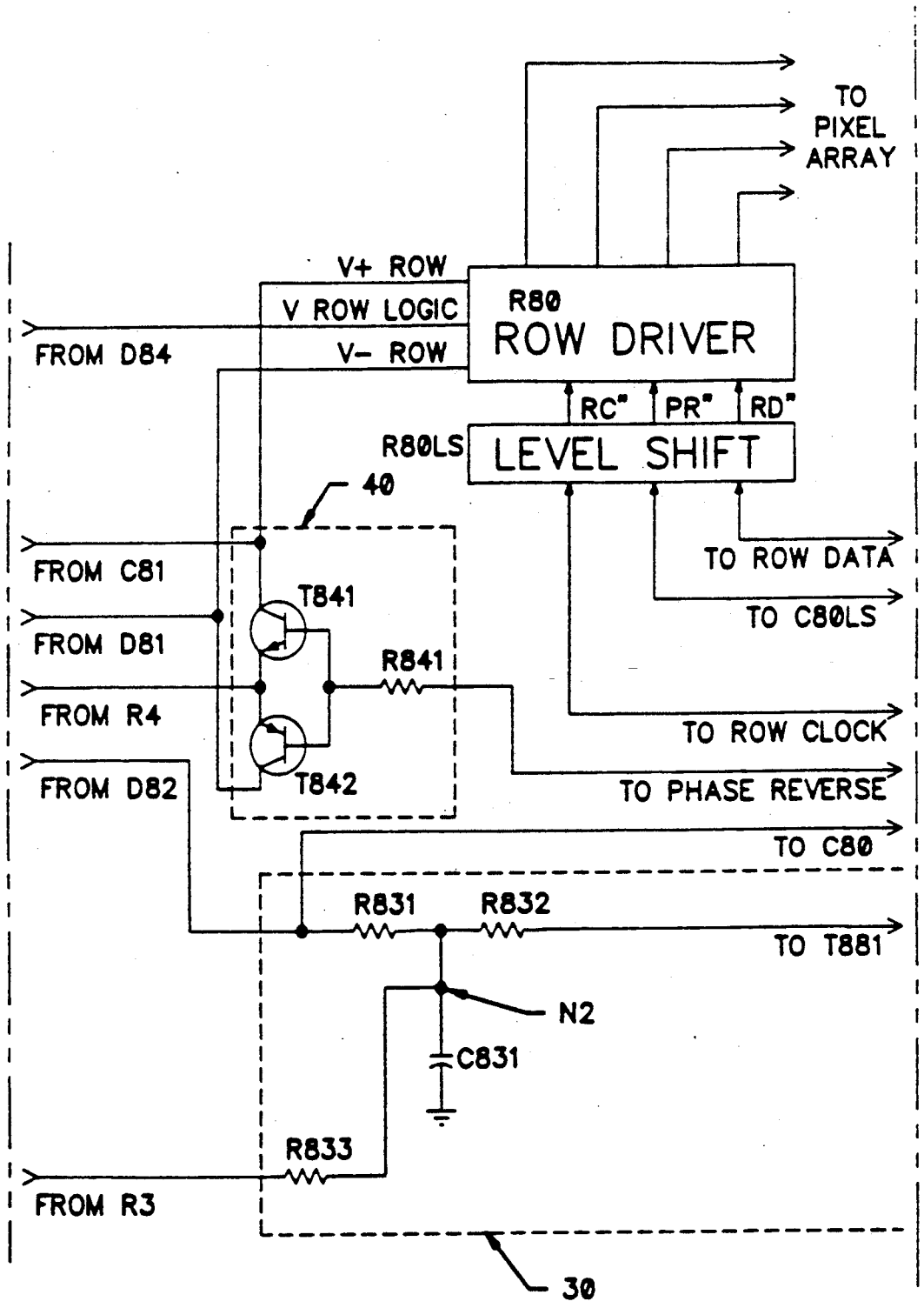
Figures 3, 8:
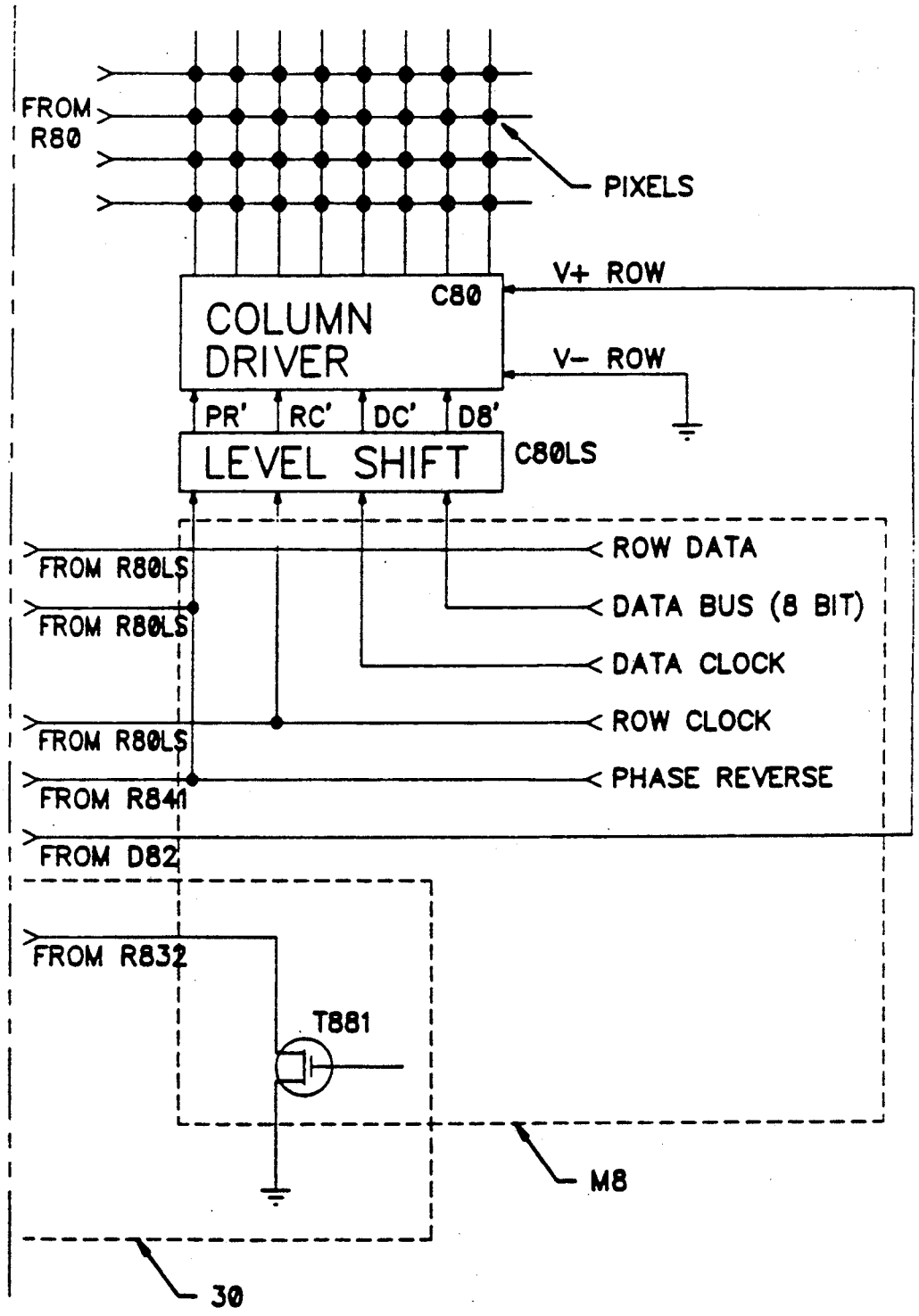
Figures 1, 9:
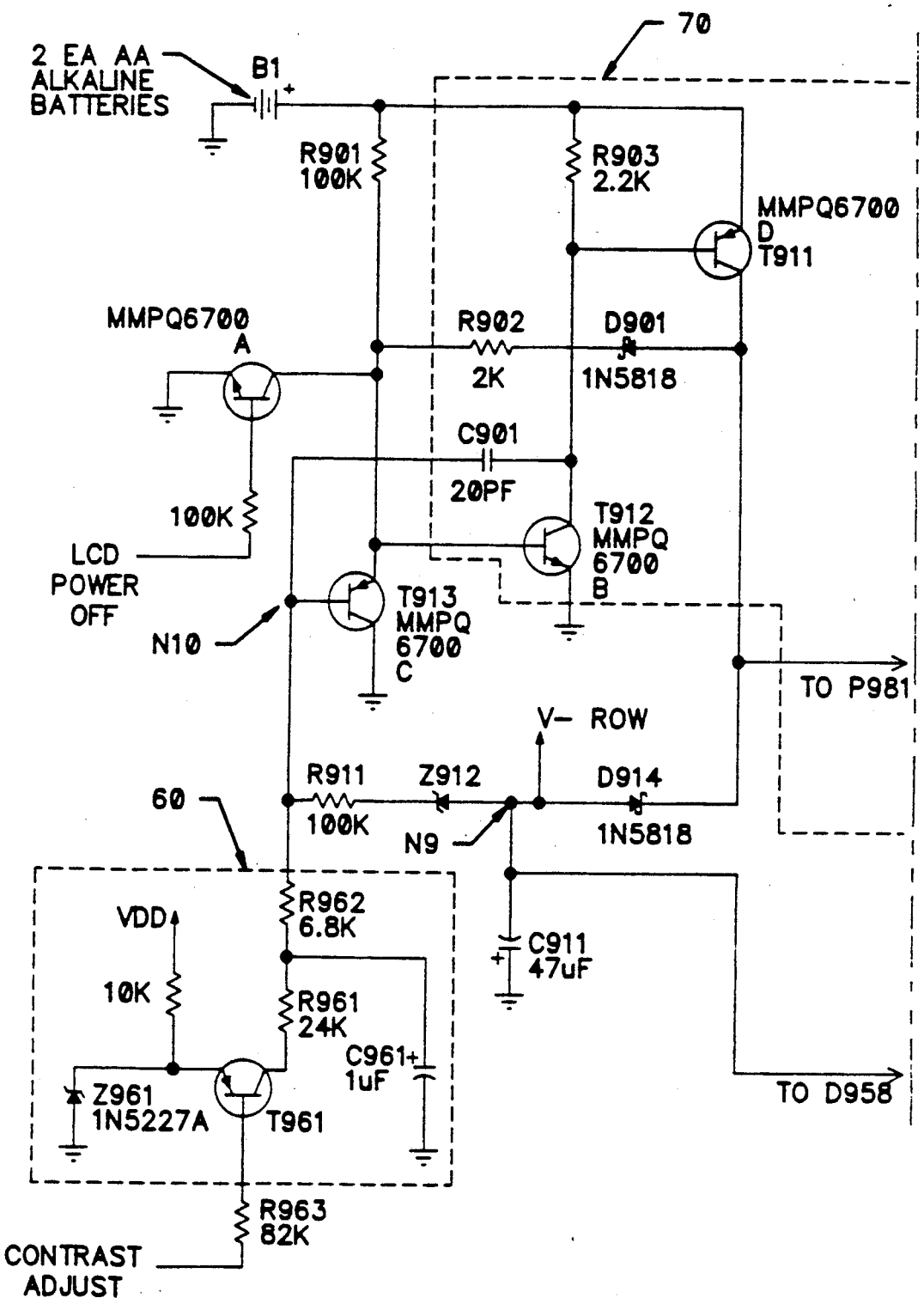
FIG. 9, comprising sections 9-1, 9-2, and 9-3, shows a switching regulator circuit in accordance with another embodiment of the present invention in which voltage regulation is based on the row drive voltage.
Figures 2, 9:
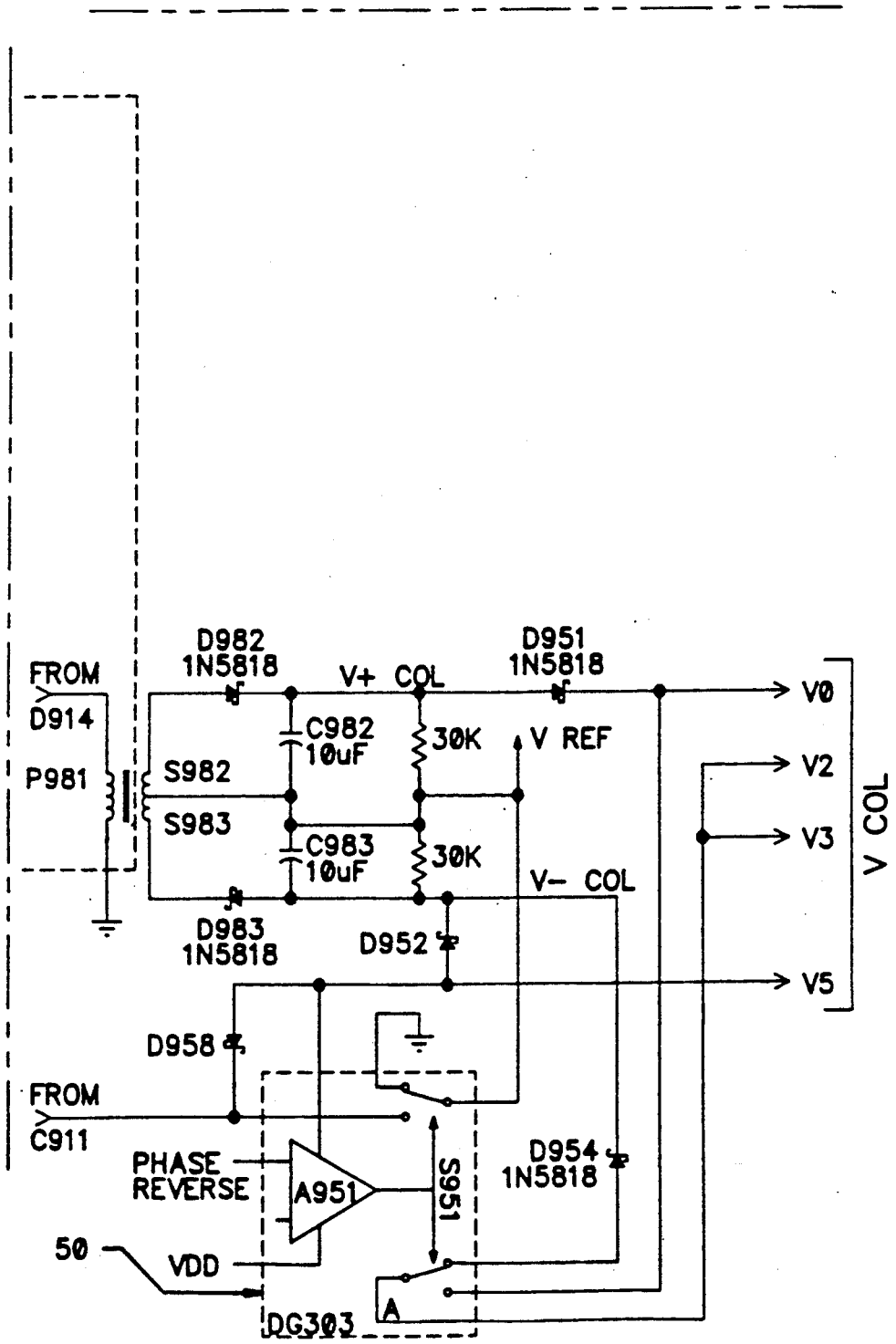
Figure 9:
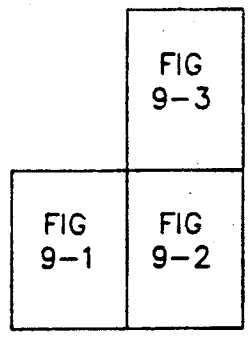
Figure 3:
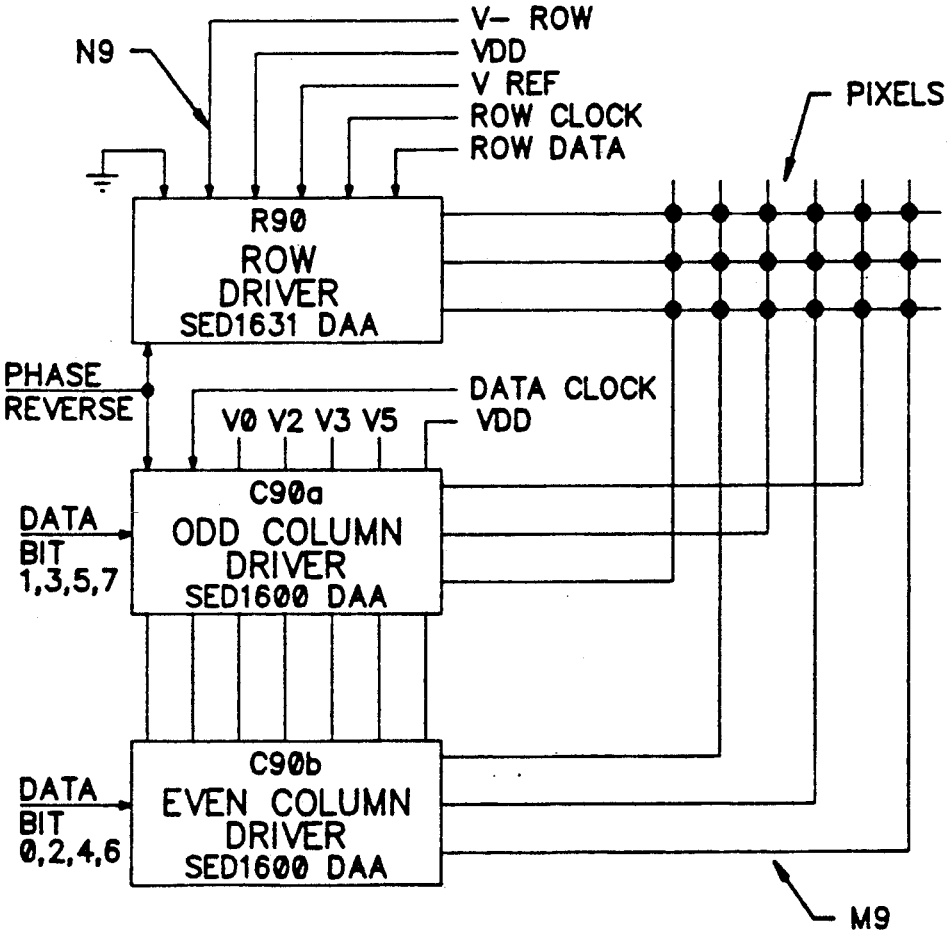

The operation of the switching regulator of this invention will be described for several examples shown in FIGS. 7*a*, 8, and 9. It will be shown why the switching regulator circuit of FIG. 7*a* is undesirable and why the circuits of FIGS. 8 and 9 are preferred.

Figure 6:
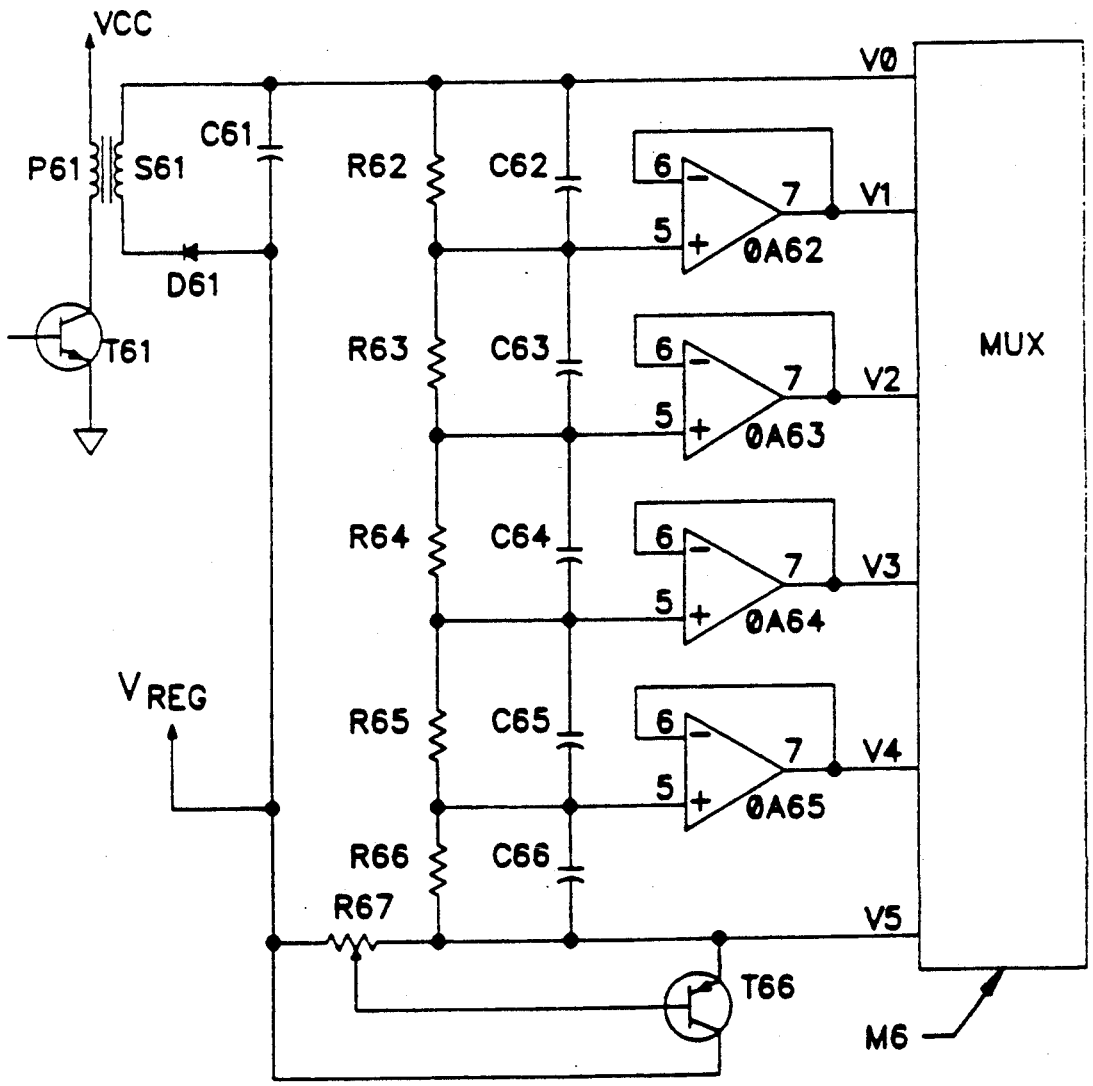
FIG 6 PRIOR ART
FIG. 6 shows a typical prior art voltage divider circuit for generating the necessary voltages for driving rows and columns.
Figure 7A:
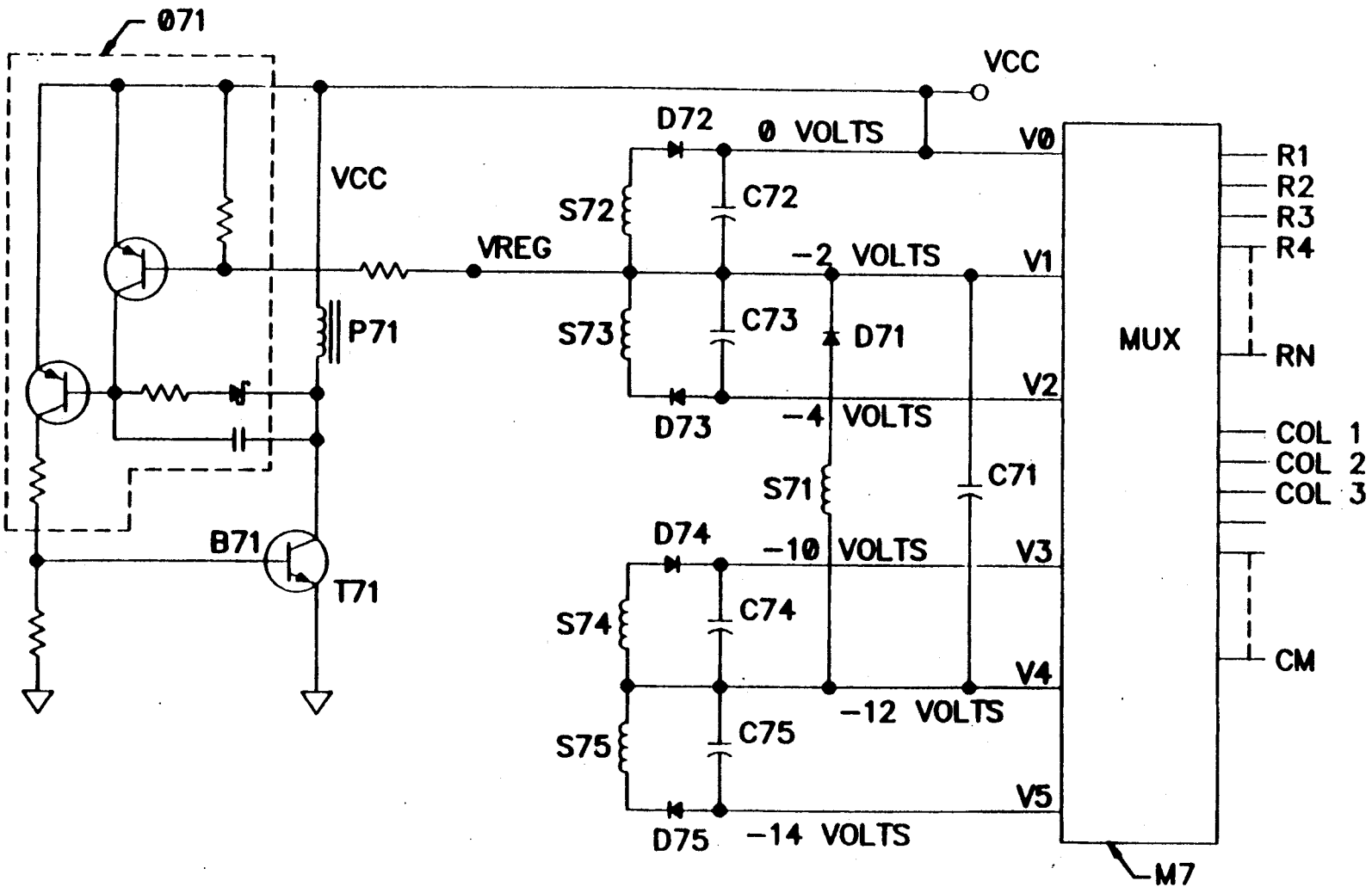
FIG. 7*a* shows one switching regulator circuit for driving rows and columns using five voltages, provided here to illustrate the undesirable aspects of such an arrangement.

FIG. 7*a* shows one switching regulator circuit for generating the same five voltages generated by the circuit of FIG. 6, but without using resistors and operational amplifiers. A current path exists from a voltage supply Vcc through primary winding P71 and transistor T71 to ground. Secondaries S71 through S75 are driven by primary winding P71. Secondary winding S71 forms a loop with capacitor C71 and diode D71. When primary P71 causes secondary S71 to drive current in the forward direction through diode D71, capacitor C71 becomes charged. When primary current drives secondary S71 to send current in the backward direction of diode D71, no current can flow, and the charge remains on capacitor C71. Thus, capacitor C71 provides a voltage difference between multiplexer input leads V1 and V4. Likewise secondary winding S72 forms a loop with capacitor C72 and diode D72, capacitor C72 becoming charged and providing a voltage difference between multiplexer input leads V1 and V0. Similarly, secondary S73, capacitor C73, and diode D73 provide a voltage difference between input leads V1 and V2; secondary S74, capacitor C74, and diode D74 provide a voltage difference between input leads V3 and V4; and secondary S75, capacitor C75, and diode D75 provide a voltage difference between input leads V4 and V5. Current through primary winding P71 is controlled by applying control voltages to the base B71 of transistor T71. Voltage regulator line $V_{reg}$ provides feedback to oscillator 071, which in turn controls the length of time a high voltage is applied to the base B71 of transistor T71. Turning on transistor T71 for a larger portion of the time will in turn cause oscillator 071 to be turned on for a larger portion of the time. Operation of primary winding P71 for a larger portion of the time causes current to be generated in secondary windings S71 through S75 for a larger portion of the time with resultant higher charges on capacitors C71 through C75. Thus the magnitude of the voltage applied to input ports V0 through V5 of multiplexer M7 can be controlled by controlling the turn-on time of transistor T71, using feedback from voltage regulator $V_{reg}$.

Figure 7B:
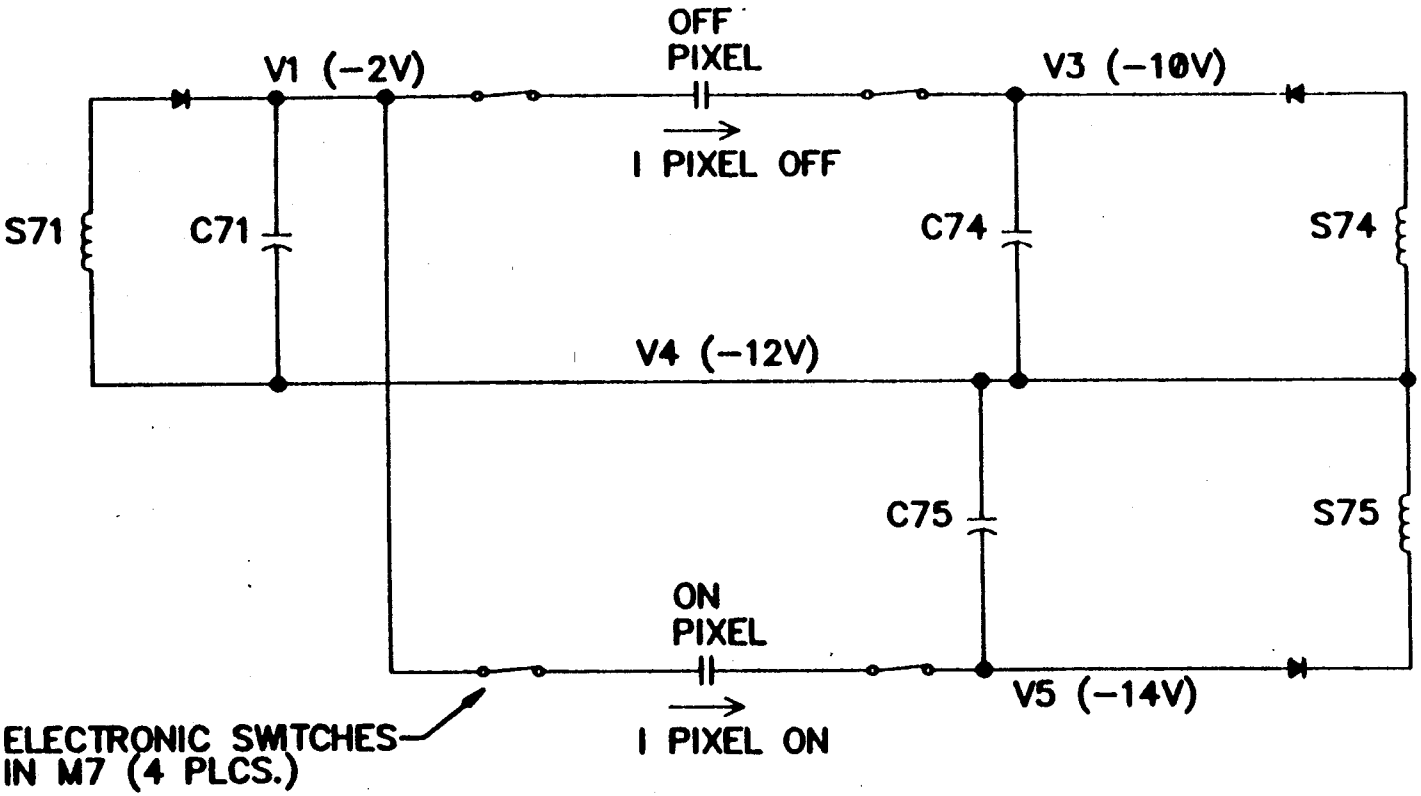
FIG. 7*b* shows the equivalent circuits experienced by OFF and ON pixels when driven by the circuit of FIG. 7*a*.

The relative values of voltages V0 through V5, however, are determined by the number of windings in the respective coils. In this case the number of windings on secondaries S72, S73, S74 and S75 is made equal. The circuit of FIG. 7 is unacceptable for the following reason. The voltages across capacitors C72, C73, C74 and C75 are only equal if the currents drawn by multiplexer M7 inputs V0, V2, V3 and V5 are equal. Since leads V0 and V5 supply voltage for alternative phases of the same signal, for example column voltages of all the ON pixels, currents will be equal and voltages across capacitors C72 and C75 will therefore be equal. The same is true for multiplexer inputs V2 and V3. Therefore, voltages across capacitors C73 and C74 are equal. However, since V0 drives ON pixels and V2 drives OFF pixels, current through lead V0 is equal to current through lead V2 only if the number of ON pixels is equal to the number of OFF pixels. Likewise for leads V3 and V5. FIG. 7*b* shows the equivalent circuits experienced by OFF and ON pixels when driven by the circuit of FIG. 7*a*. The $-2$ volt level on node V1 of capacitor C71 and $-10$ volt level at node V3 of capacitor C74 which cause current to flow from capacitor C71 to capacitor C74 produce an increase in the charge on capacitor C74. However, the $-2$ volt level on node V1 of capacitor C71 and $-14$ volt level on node V5 of capacitor C75 which cause current to flow to node V5 cause a decrease in charge on capacitor C75. This produces the difference in voltage levels stored on capacitors C74 and C75. Since only one of the voltages can be used for regulation, in this case the difference between V0 and V1, voltages V2 and V3 will be improperly regulated for most images and image quality will therefore be poor.

Preferred Circuit for Generating Three Voltages

FIG. 8, comprising sections 8-1, 8-2, and 8-3, shows another circuit for generating the voltage waveforms seen by the pixels of FIG. 5*c*. In the circuit of FIG. 8 only three voltages must be generated in addition to the reference voltage. The circuit of FIG. 8 has the advantage over that of FIG. 7*a* that currents drawn from capacitors which drive the columns are precisely equal and that voltage can be precisely regulated, resulting in good image quality. The circuit of FIG. 8 has the additional advantage that components supplying the column voltages may be manufactured to tolerate only the low column voltage, on the order of 2 volts, thus the device may be smaller, lower in power, and less expensive to manufacture.

Because the load to the power supply provided by the display varies widely depending upon how many pixels are on, the voltage regulator must have a high efficiency over a wide range of display load.

In FIG. 8, primary winding P81 is driven by alkaline batteries, B1, through an oscillator comprising resistors R811, R812, PNP transistor T811, NPN transistor T812, resistor R813, capacitor C811 and diode D813. Frequency is determined by the relative values of the capacitor and resistors. When negative voltage feedback transistor T821 turns off, start-up resistor R801 sources positive voltage to initiate the oscillation. When transistor T821 turns on, transistor T812 turns off and the oscillation ceases, with a resultant cessation of power delivered by primary P81.

Secondary winding S81, diode D81, and capacitor C81 form a loop which generates a charge on capacitor C81, as discussed earlier. The charge on capacitor C81 supplies the row select voltage. Switch 40, which is comprised of transistors T841, T842, and resistor R841, allows the single voltage difference across capacitor C81 to supply both positive and negative pulses for the selected row. Under control of the PHASE REVERSE signal, switch 40 alternately connects one or the other plate of capacitor C81 to a reference voltage, VREF, which references the center tap of the column voltage windings S82 and S83. This controls the polarity of voltage applied to the liquid crystal display. Row driver R80 (which functions as does row driver R90 described hereafter in connection with FIGS. 9 and 10) selects which of voltages V+ROW and V−ROW is applied to the selected row line as determined by the scan routine discussed above and two scan routines to be discussed hereafter. Since the same capacitor supplies the voltage difference during the two portions of the row select time, the voltage difference is precisely equal in amplitude and opposite in polarity during the two halves of a row select time, for a resultant DC voltage applied to the row side of the selected row of pixels of precisely zero.

Secondary winding S82, diode D82, and capacitor C82 form one loop and secondary winding S83, diode D83, and capacitor C83 form the other loop for supplying the column voltage. During one half of a row select time one of capacitors C82 and C83 supplies voltage to a particular column and during the other half of that row select time the other of capacitors C82 and C83 supplies voltage to that column. Column driver C80 (which functions as do column drivers C90*a* and C90*b* discussed in connection with FIGS. 9 and 10) selects which of voltages V+COL and V−COL (ground) is applied to each column as determined by the intended state of the pixel in the selected row. All columns are connected simultaneously to either capacitor C82 or capacitor C83 and switch between capacitor C82 and C83. In the first scan method switching is in the middle of a row select time. (Which capacitor supplies voltage first depends upon which row voltage was supplied first and upon whether the pixel in the selected row is to be ON or OFF.) Capacitors C82 and C83 are identical and windings S82 and S83 are identical. Thus over the length of one row select time in the first scan method capacitors C82 and C83 deliver equal amounts of charge (integrated currents are equal). Therefore according to the first scan method, the magnitudes of voltages between V+ROW and VREF and between V−ROW and VREF are identical. Diodes D82 and D83 are also identical, and connected so that the voltages V+COL and V−COL have opposite polarities. Therefore the column voltages received from capacitors C82 and C83 have a resultant DC voltage of precisely zero.

Since both row and column voltages have a resultant DC voltage of precisely zero, the net DC voltage experienced by a pixel is precisely zero, resulting in long life of the display.

The RMS average amplitude of voltage experienced by each pixel, which determines whether that pixel is ON or OFF is controlled by column driver C80. As shown in FIGS. 5*a*–5*c*, if the column voltage has the same polarity as the row voltage a pixel will be OFF. FIG. 5*a* shows the pixel in Row 1 column 1 as OFF (black). FIG. 5*b* shows the select voltage in row 1 at row 1 select time to comprise first a low voltage followed by a high voltage. The column voltage in column 1 at row 1 select time comprises a low voltage followed by a high voltage. Thus, as shown in FIG. 5*c*, the select voltage to the pixel in row 1 column 1 during row 1 select time is relatively low and produces an integrated voltage causing that pixel to be OFF. By contrast, the row and column voltages applied to row 1 column 2 are of opposite polarities and the pixel in row 1 column 2 is ON.

Returning to FIG. 8, row drive multiplexer R80 applies row select voltages which are switched between the two voltage values V+ROW and V−ROW. Column drive multiplexer C80 applies column voltages supplied by V+COL and V−COL from secondaries S82 and S83 as selected by the data presented to column drive multiplexer C80, thereby controlling RMS average amplitude to each pixel and the OFF/ON state of each pixel.

Preferred Voltage Regulation

In order to drive the display with the minimum power and retain high contrast between ON and OFF pixels, it is necessary to regulate the voltage of the driving circuits accurately to maintain the OFF RMS voltage seen by the pixels equal to the threshold voltage. According to the example of FIG. 2, the threshold voltage is 1.893 volts and the transition voltage is 0.13 volts. At 1.893 volts, reflectance is approximately 10% of the maximum value for the material whereas at 2.02 volts, reflectance is approximately 90% of the maximum. Thus good contrast at low power will occur for an OFF voltage of about 1.893 volts and an ON voltage of about 2.024 volts. Maintaining the voltage level experienced by the pixel during the unselected portion of the waveform at 1.6 volts and using a 16-volt row select voltage will result in a 14.4 volt signal for an OFF pixel during its row select time, raising the RMS voltage experienced by an OFF pixel to the desired $$V_{OFF} = \frac{\sqrt{(1) \times (14.4^2) + (199) \times (1.6^2)}}{200} = 1.893 \text{ volts}$$

These parameters will result in a 17.6 volt signal for an ON pixel during its row select time raising the RMS voltage experienced by an ON pixel to $$V_{ON} = \sqrt{\frac{(1) \times (17.6^2) + (199) \times (1.6^2)}{200}} = 2.024 \text{ volts}$$

Figure 1:
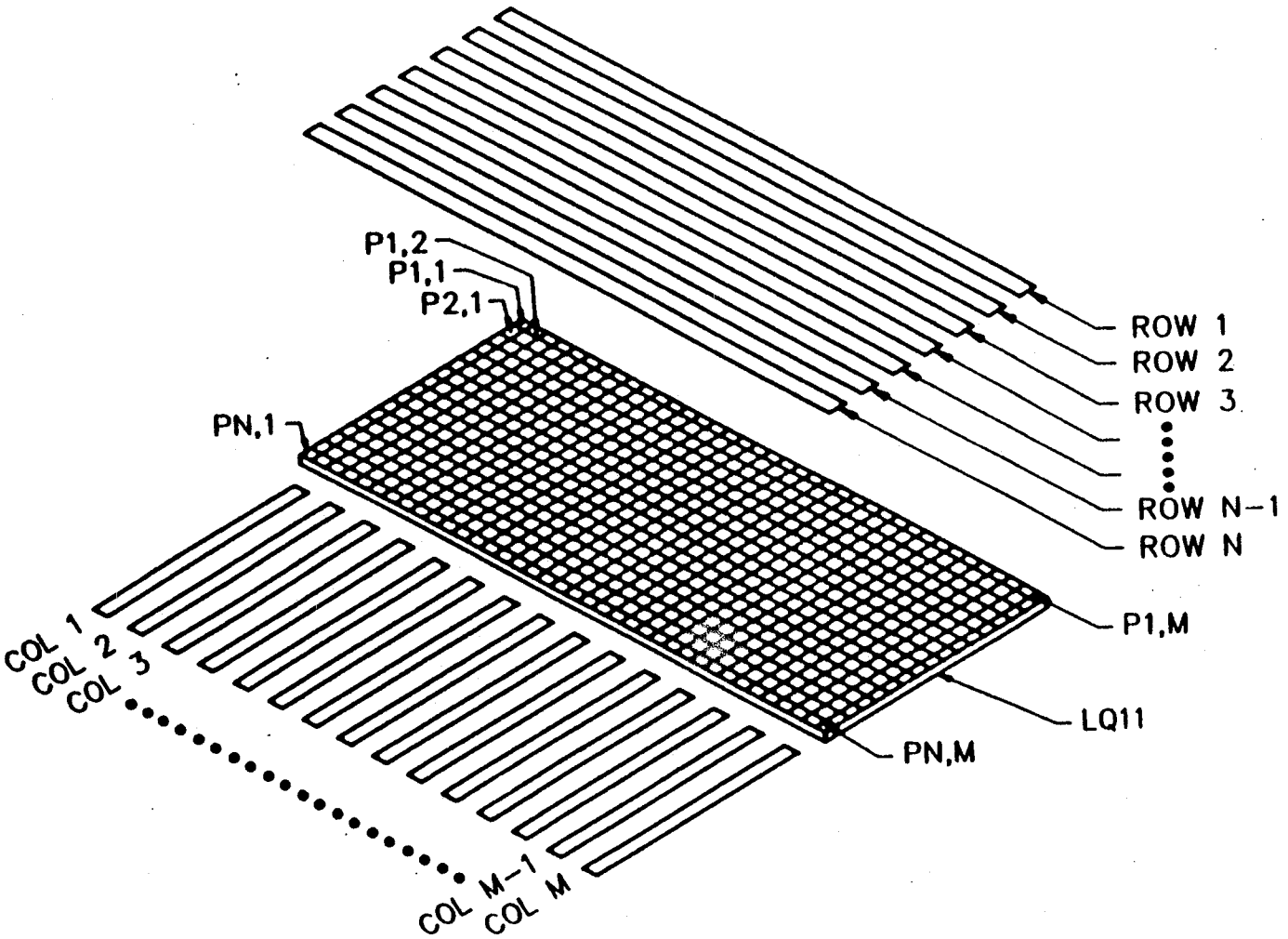
FIG 1 PRIOR ART
FIG. 1 shows an exploded perspective view of a rectangular array of pixels in a typical liquid crystal display.
Figure 2:
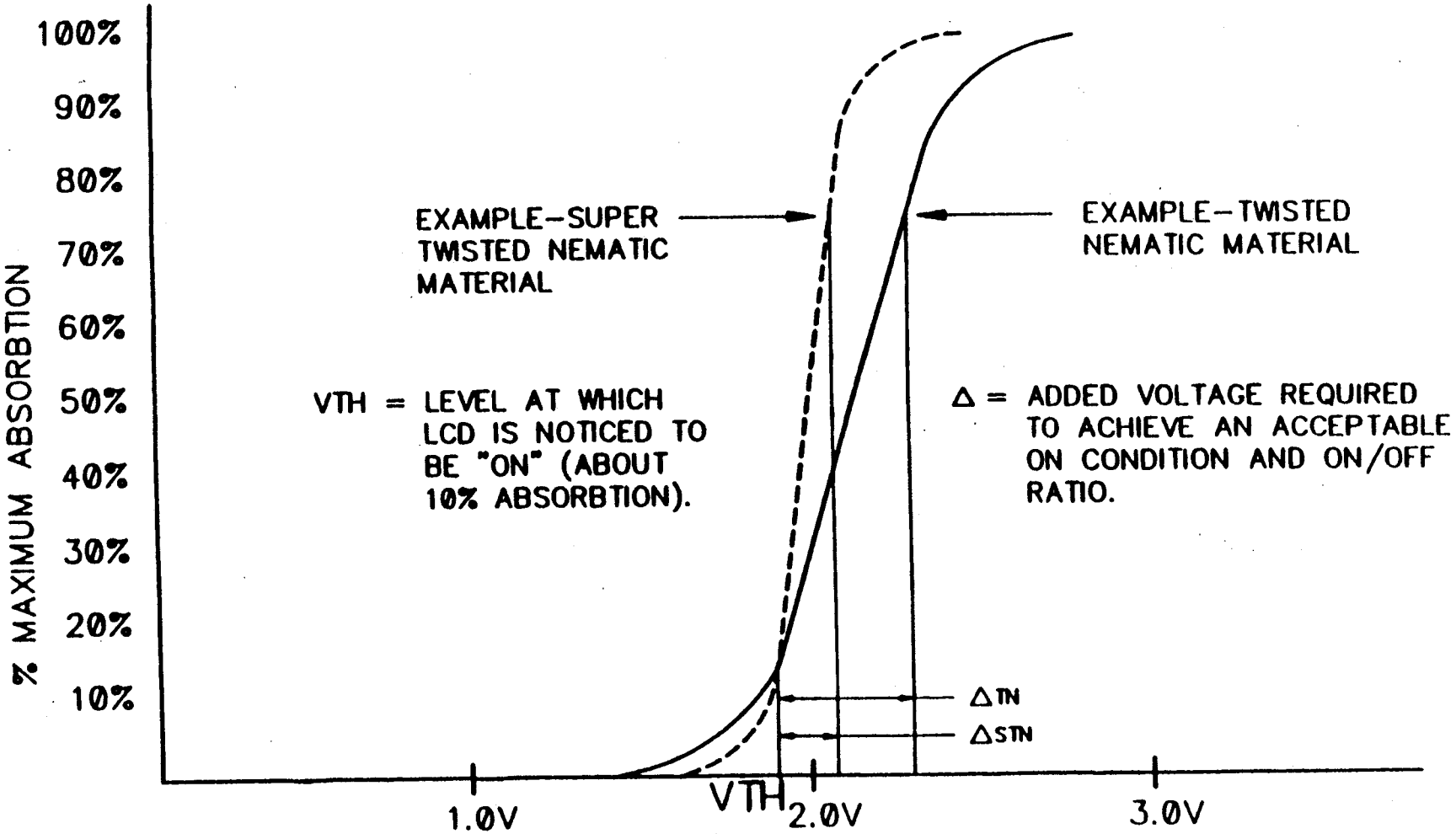
FIG 2 PRIOR ART
FIG. 2 shows reflectance curves for typical old and new liquid crystal materials.

Therefore regulating the unselected voltage to be 1.6 volts will achieve an image with good contrast for the reflectance curve of FIG. 2. Since frequency varies by no more than a 2:1 ratio, the voltage presented across the plates of capacitors C82 and C83 can be maintained constant by applying voltage from the VREF line to control current in the primary winding.

Regulating the unselected voltage is a novel feature of this invention and important to achieving optimum contrast of the display unit. As shown in FIG. 8, the VREF signal supplies the reference voltage which controls the level of the positive and negative column voltages V+COL and V−COL through windings S82 and S83. VREF therefore determines the voltage difference between rows and columns during unselected row times. One of the column voltage signals, in this case VREF−V−COL, is used to control the voltage presented to feedback transistor T821. This way the voltage present most of the time (in the above example, 199/200 of the time) is carefully regulated, and the voltage levels consistently maintain optimum contrast in the display. A slight variation in the high voltage applied when a large number of consecutive pixels are ON will have less effect on the optimum contrast because this high voltage signal is applied only a small portion of the time. The threshold voltage remains properly regulated.

Temperature Compensation

Since threshold voltage varies with temperature, a circuit for regulating voltage as a function of temperature is also desirable to maintain optimum contrast. The circuit shown in FIG. 8 regulates the on-time of primary P81 with the reference voltage VREF. Regulating from the low voltage makes it convenient to apply the reference voltage VREF across the base emitter junction of transistor T821. Further, the variation in base-emitter voltage drop with temperature means that the base-emitter voltage of transistor T821 almost exactly matches the temperature coefficient needed by the display.

Contrast Control

Contrast control circuit 30 includes control transistor T881 having its source at ground, controlled by the drive logic M8, a resistor divider comprising resistors R832 and R831 separating node N2 from the drain of transistor T881 and the V+ column voltage provided by secondary S82 through diode D82 respectively, capacitor C831 between node N2 and ground, and resistor R833 between node N2 and the control terminal of voltage feedback transistor T821. When the duty cycle of transistor T881 is increased, as controlled by drive logic M8, the voltage at node N2 as stored on capacitor C831 moves toward ground. The lower voltage on node N2 tends to pull down the voltage at the base of transistor T821, which causes transistor T821 to turn off at a higher value of voltage VREF, in turn reducing the values of the applied ON and OFF voltages to the display. A decrease in duty cycle of transistor T881 will have the opposite effect. The duty cycle of transistor T881 is software controlled and the software is preferably programmed to respond to keyboard commands from the user.

Level Shifting

Figure 11B:
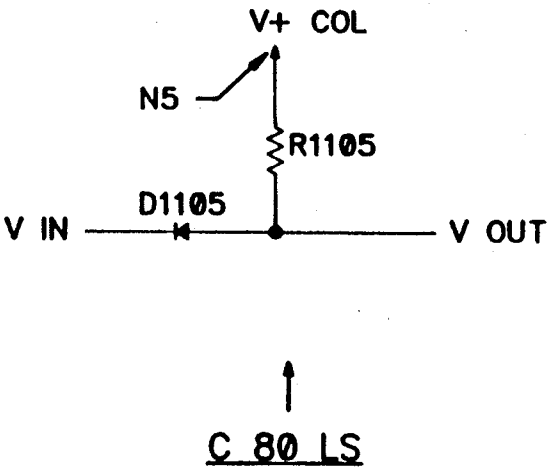
FIGS. 11*a* and 11*b* show the circuit details of the level shift circuits used in FIG. 8.

Level shift circuits R80LS and C80LS, described in detail hereinafter, receive digital signals having logic levels provided by drive logic M8 and provide as output signals to the row and column drivers R80 and C80 respectively, which in the case of the row driver indicate which row is selected and for the column driver indicate which columns are to be OFF or ON in the selected row. Logic levels of drive logic M8 are preferably 3 to 5 volts for a logic "1" and 0 volts for a logic "0". A preferred circuit M8 for generating drive logic signals is described in commonly assigned application Ser. No. 07/374,884 filed on 06/30/89 invented by Leroy D. Harper, John W. Corbett, Douglas A. Hooks, Grayson C. Schlichting, Renee D. Bader and John P. Fairbanks entitled "Video Image Controller for Low Power Computer". The content of this copending application is incorporated herein by reference. Column level shifter C80LS must provide output voltages similar to its input voltages, therefore, a simple level shifter such as shown in FIG. 11*b* is sufficient for generating each of column driver signals DC', DB', RC' and PR' from DATA CLOCK, DATABUS (8-bit), ROW CLOCK and PHASE REVERSE signals respectively. A 3 to 5 volt signal applied to the cathode of diode D1105 of FIG. 11*b* produces an output voltage at $V_{OUT}$ approximately equal to the voltage V+COL applied to node N5. A zero volt input signal applied to the cathode of diode D1105 produces an output voltage $V_{OUT}$ of 0.7 volts, one diode drop above the input voltage.

Figure 11A:
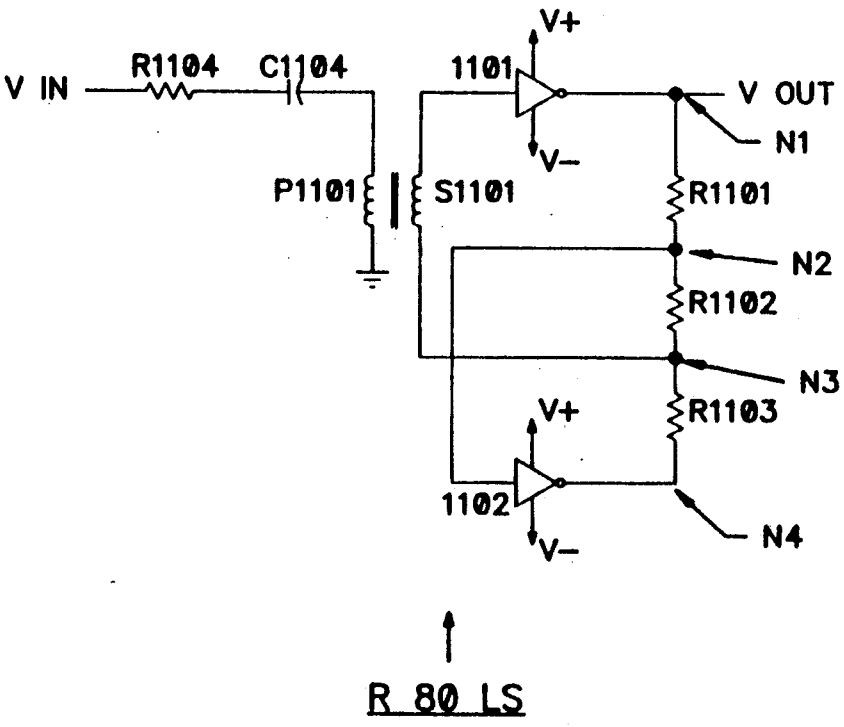

Because signals being input to the row level shifter R80LS are low voltage signals in the range of 0 to 5 volts and the signals to be provided by level shifter R80LS to row driver R80 must be shifted up to 11 volts more positive than the input signal (in this embodiment) for one half the phase and shifted up to 5 volts more negative for the other half of the phase, the level shifter must completely electrically isolate the input signal from the output signal. For each of the signals ROW DATA, ROW CLOCK and PHASE REVERSE, a 21 circuit such as shown in FIG. 11*a* preferably performs the level shifting. As shown in FIG. 11*a*, the input signal Vin is applied through a capacitor-resistor network comprising resistor R1104 in series with capacitor C1104 to primary coil P1101. As is well known, current through primary P1101 rises or falls over some period of time because of the capacitor resistor network, causing a corresponding voltage in secondary S1101 which rises steeply and falls gradually.

This secondary voltage is applied to the input of inverter 1101. In a three-volt system in which the CMOS inverter 1101 switches state at an input voltage of 1.5 volts, an input voltage below 1.5 volts will produce an output voltage at node N1 of 3 volts. An input voltage above 1.5 volts will produce an output voltage at node N1 of 0 volts. In the case of a low input signal to inverter 1101, the high voltage at node N3 produced by the impulse on secondary S1101 combined with the high voltage at node N1 produced by the output of inverter 1101 cause a corresponding high voltage at node N2 which is applied as the input to inverter 1102. This in turn produces a low voltage at node N4 on the output of inverter 1102. The low voltage at node N4 remains after the voltage difference provided by secondary S1101 has decayed. The circuit reaches an equilibrium in which the voltages at nodes 1 and 4 are 3 volts and 0 volts respectively, and the voltages at nodes N2 and N3 depend upon the values of resistors R1101, R1102, and R1103. If these three resistors are equal in value, node N2 will be at 2 volts and node N3 will be at 1 volt. This 1-volt level at node N3 will be applied to the input of inverter 1101. A subsequent pulse which again drives the input to inverter 1101 low will not produce a change in the output signal provided at node N1. The circuit remains in a stable state. To change the state of this circuit requires that secondary S1101 move the voltage on the input of inverter 1101 above 1.5 volts. Since the input of inverter 1101 settles at 1 volt in this example, a change of only 0.5 volts to just above 1.5 volts causes inverter 1101 to switch states. When inverter 1101 switches states, node N1 will go to 0 volts. At this instant, node N4 is also at 0 volts, therefore the voltage on node N2 will go low and inverter 1102 will change states, driving node N4 to 3 volts. Nodes N2 and N3 will then approach 1 and 2 volts respectively.

Thus the level of the upper inverter input switches between 1 and 2 volts for the two states, and a small transition in the input voltage level can cause a change in level of the output signal on node N1.

By making resistor R1102 smaller than the other two, the input voltage level of inverter 1101 can be brought closer to the transition voltage, making the circuit more sensitive to pulses on primary P1101. Likewise, by making resistor R1102 larger than the other two, the circuit can be made less sensitive.

Application of Column Voltages Directly to Column Lines

Figure 11C:
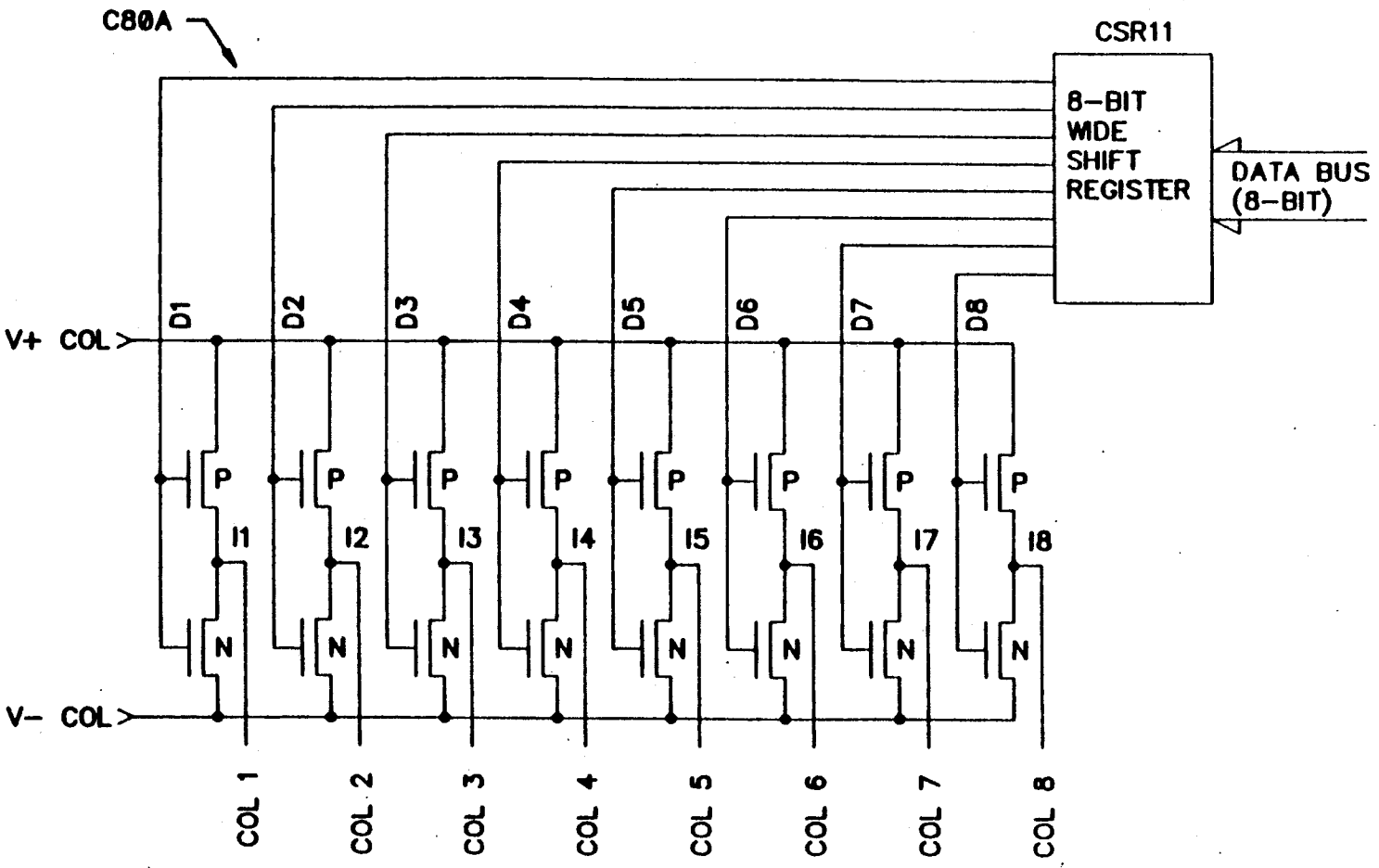
FIG. 11*c* shows one column driver circuit C80*a* which drives 8 of the columns driven by column driver C80 of FIG. 8.

As shown in FIG. 11*c*, by generating a pair of low column voltages V+COL and V−COL having magnitudes which are equal to the voltage to be applied to pixels during the unselected row times, and which are low enough to be used as first and second supply voltages for CMOS inverters, it is possible to use very simple low-voltage column drivers which include for each column line a single low voltage CMOS output device, for example inverters, for applying the appropriate voltage to the appropriate column line. Column shift register CSR11 receives 8-bit bytes of data indicating the state of pixels in 8 adjacent columns of one row. Successive 8-bit bytes are shifted to adjacent shift registers, not shown, until a clock signal (preferably provided to D-type flip flops in a well known manner) causes the 8 bits of that byte in shift register CSR11 to be placed on data lines D1 through D8. These 8 bits serve as input signals to CMOS inverters I1 through I8 respectively. These CMOS inverters receive their positive supply voltage from V+COL and their negative supply voltage from V−COL. Depending on the state of data bits on lines D1 through D8, inverters I1 through I8 place either V+COL or V−COL on column lines COL1 through COL8.

This simple method can be used for liquid crystal materials which can be driven using column voltage supplies where the voltage difference between V+COL and V−COL is in the range of 2.5 to 12 volts. It is very advantageous to be able to manufacture column drivers using all low voltage supplies as shown in FIG. 11*c* because these can be made much smaller than frequently used column drivers which source and sink current from 12 to 25 volt supplies.

In order for this method to function properly, the reference voltage from which V+COL and V−COL are varied must be fixed to near the same point as that from which the data signals of shift register CSR11 and the data bus signals are referenced. FIG. 8 shows V−COL tied to ground. It is also possible to tie VREF to ground (and concurrently take the feedback voltage from V+COL or V−COL.

Figure 11D:
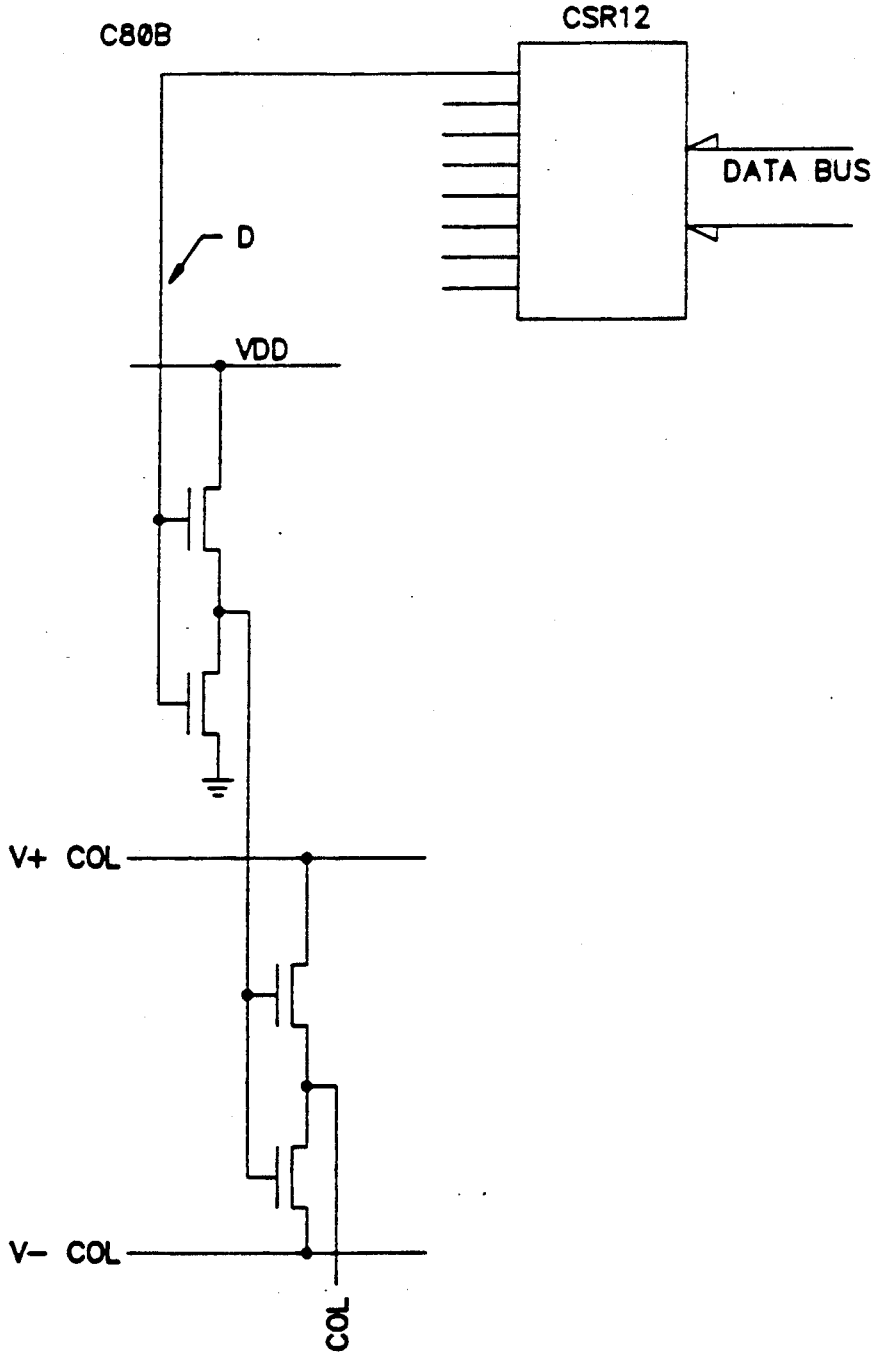
FIG. 11*d* shows a column driver circuit C80*b* in which a buffer receives a data signal and in response applies one of two generated voltages to a column line.

As an alternative, if the input data levels are not appropriate for directly applying data to the inputs of CMOS inverters which drive the column lines, such as inverters I1 through I8 as shown in FIG. 11*c*, a buffering stage may be provided as shown in FIG. 11*d*, retaining the advantage of small component size from low voltage operation.

Figures 1, 10:
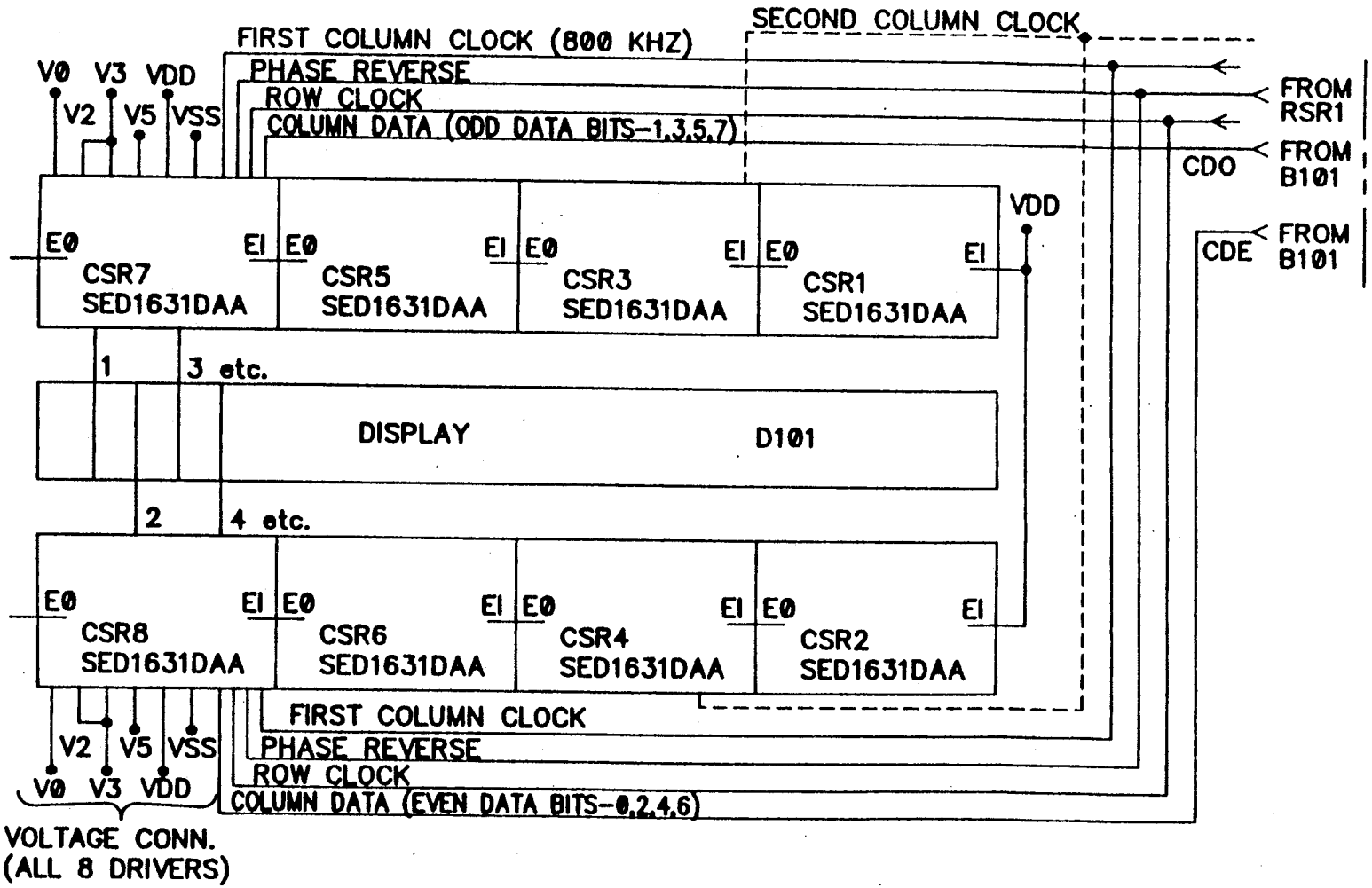
FIG. 10, comprising sections 10-1, 10-2, and 10-3, shows a circuit diagram of the switching regulator and driver circuit of the embodiment of the invention shown in FIG. 9.
Figures 2, 10:
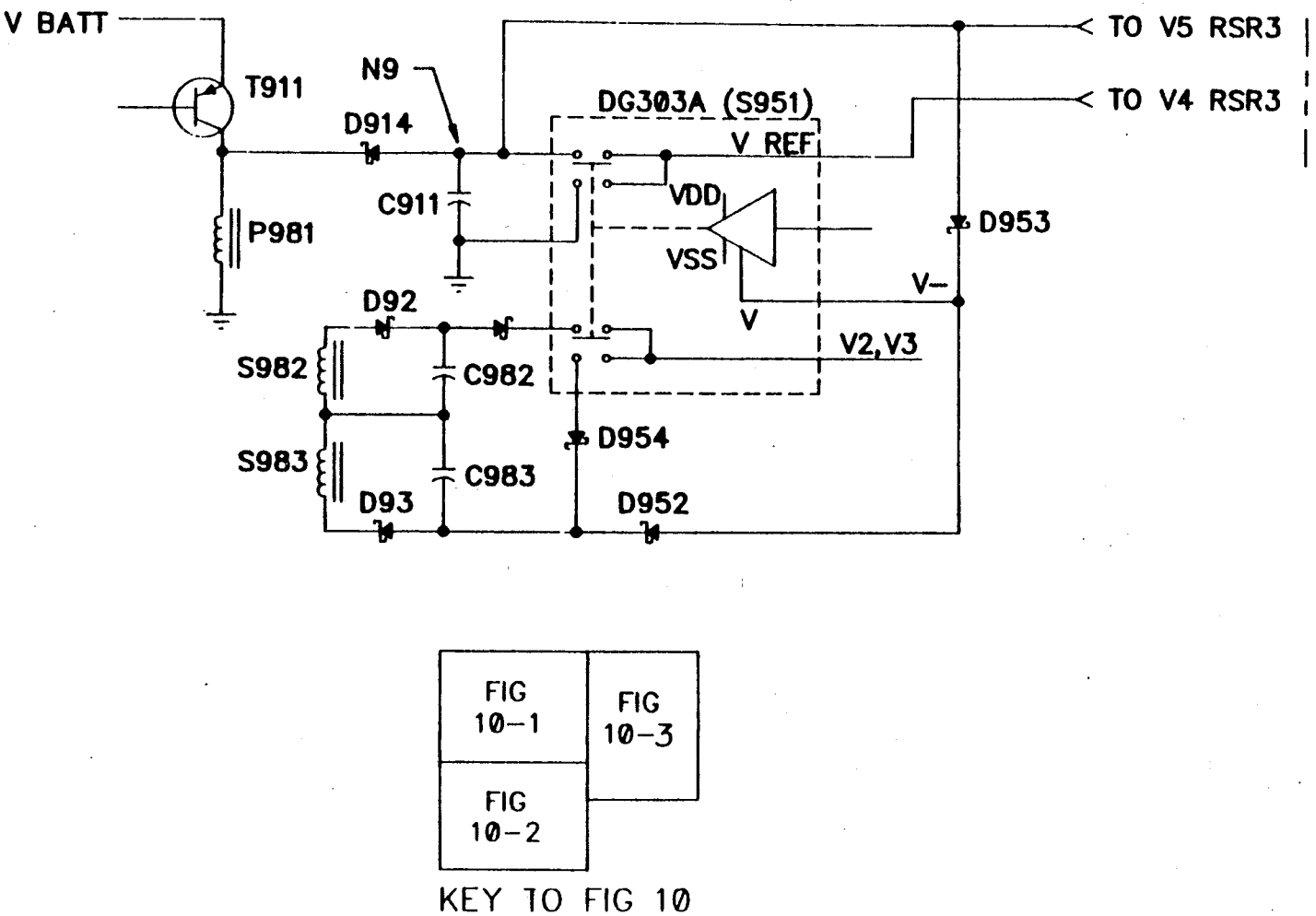
Figures 3, 10:
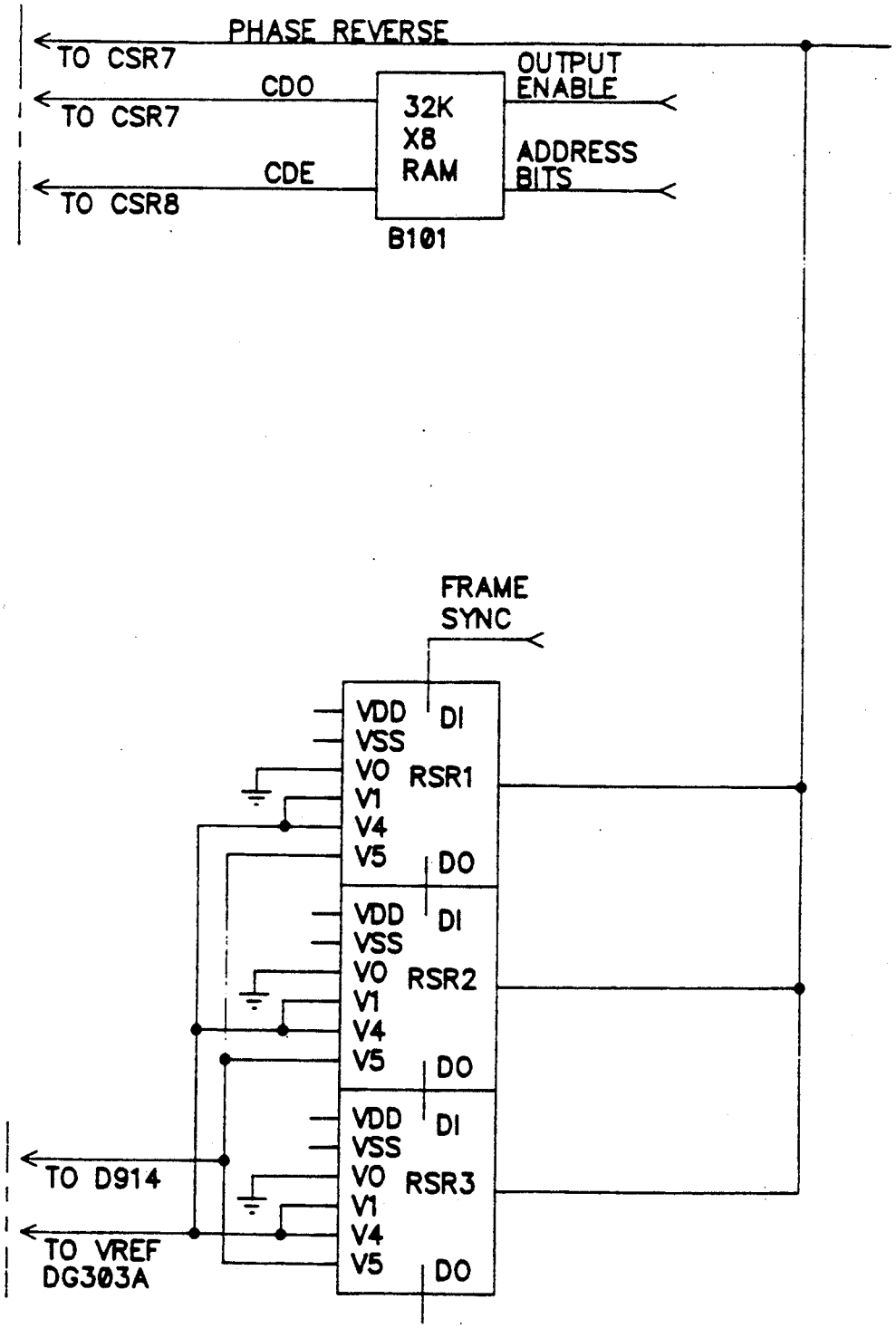

Circuit for Generating Three Voltages which Regulates from High Generated Voltage FIGS. 9 and 10 show another embodiment of the switching regulator of this invention. The same embodiment is shown in both figures, different portions of the circuit being shown at different levels of detail in the two figures. FIG. 9, comprising sections 9-1, 9-2, and 9-3, shows in detail the means for generating the row and column voltages and for providing appropriate voltage levels to the rows and columns of pixels. FIG. 10, comprising sections 10-1, 10-2, and 10-3, shows in detail the means for receiving the generated voltage levels V0, V2, V5, −VROW, and VREF, and applying them to particular rows and columns in response to digital data signals DATA/ODD and DATA/EVEN indicating which pixels are to be ON and OFF.

In FIG. 9, an oscillator 70 including transistors T911 and T912, resistors R901, R902, and R903, diode D901 and capacitor C901 drives primary winding P981, in a manner similar to the oscillator 10 of FIG. 8. Primary winding P981 drives secondary windings S982 and S983 which provide column voltages. The row driving voltage is provided by primary winding P981 at node N9. Thus in FIG. 9 the row driver voltage is not transformer isolated, in contrast to FIG. 8 in which both the row and column driver voltages were transformer isolated.

When transistor T911 is on, current through winding P981 builds up, so that when transistor T911 is shut off by the lowered voltage across resistor R903, the continued current through winding P981 causes a voltage drop at the cathode of Schottky diode D914, building up a negative voltage at node N9 as stored on capacitor C911. Zener diode Z912 breaks down at approximately the minimum row voltage which may be preferred for optimum image contrast at high temperature, which in the embodiments discussed here is 16 volts. The voltage applied to the base of PNP transistor T913 is further adjusted by contrast control circuit 60 (circuit 60 is explained below), so that the voltage across primary winding P981, and the related voltages across secondary windings S982 and S983 are maintained at the selected regulation levels.

Voltage Regulation

Turning on transistor T913 pulls down the base of transistor T912, turning off oscillator 70. When oscillator 70 is off, voltage across capacitor C911 decreases until the corresponding voltage at the base of transistor T913 has a sufficiently small negative value to turn off transistor T913, turning on transistor T912 and restarting oscillator 70. Thus in this embodiment, voltage is regulated from the higher row voltage between node N9 and ground rather than the lower column voltage regulation in the embodiment of FIG. 8.

While transistor T913 is off, oscillator 70 drives a corresponding voltage increase in all three windings P981, S982 and S983. The three diodes D914, D982, and D983 prevent current from flowing in their backward direction, producing an increase in voltage difference on capacitors C911, C982, and C983 respectively. When the voltage difference on capacitor C911 as presented at node N9 is sufficiently negative, switching transistor T913 will again be triggered to turn on, and remain on as long as the voltage on node N9 is sufficiently negative.

The switching regulators in FIGS. 8 and 9 operate as ON/OFF regulators as opposed to conventional regulators which vary the peak switching currents to adjust to varying load conditions. The ON/OFF regulators of this invention have sufficient gain in the feedback loops that the oscillators are either completely on or completely off most of the time. An oscillator turns on when the absolute value of the regulated voltage is less than specified and turns off when the absolute value of the regulated voltage is more than specified. This ON/OFF mode of regulation achieves near peak efficiency over a much wider range of load currents than the conventional regulators which vary peak switching current.

The method of turning off the oscillator insures that all the high current transistors used in the oscillator are fully off when the oscillator is off. This is necessary to achieve high efficiency over a wide range of output load requirements.

For example, in FIG. 9, feedback from node N9 through zener diode Z912 to node N10 controls whether transistor T913 is on or off. When transistor T913 is on, the base of NPN transistor T912 is connected to ground. Transistor T912 is one of the high current transistors of oscillator 70 and is turned fully off by having its base connected to ground. When transistor T912 is off, the base of PNP transistor T911, the other high current transistor of the oscillator is pulled high through resistor R903 so that transistor T911 is also fully off. As soon as transistor T913 is turned off, oscillator 70 begins to oscillate, generating full power to the row and column voltage supplies.

For FIG. 8, a high voltage at the base of transistor T821 turns on transistor T821, pulling down the base of NPN transistor T812, one of the high current transistors in oscillator 10, and turning transistor T812 fully off. This in turn allows resistor R811 to pull high the base of PNP transistor T811, the other high current transistor of the oscillator, thus turning this transistor fully off. As soon as a sufficiently low voltage appears on V+COL, the corresponding low voltage on the base of transistor T821 turns off transistor T821, allowing resistor R801 to quickly pull up the base of transistor T812 to start the oscillator 10.

This on/off power generation method is approximately equally efficient for oscillator switching cycles in which the on time of transistor T911 varies over almost the full range between 0% and near 100% for a wide range of load currents. By contrast, with prior art methods which regulate peak current through a primary coil in response to output voltage variation from the selected value, the efficiency rolls off at very low peak current because the leakage current through a transistor which controls current through the primary coil becomes significant when compared to the output current when this transistor is on. Thus, the on/off power generation method of the present invention which turns the main current carrying transistors of the oscillator fully off provides a significant improvement over these prior art methods.

Contrast Adjustment

Contrast adjusting circuit 60 operates as follows. Zener diode Z961 has a breakdown voltage of about 2.5 volts in this low current application. Therefore a 2.5 volt level is applied to the emitter of transistor T961. A square wave having a controllable duty cycle alternately turns on and off transistor T961. When transistor T961 is on, the 2.5 volt level at the emitter of transistor T961 causes current to flow through resistors R961 and R962 and charge to build up at node N10 at the base of transistor T913. If node N9 is not sufficiently negative for zener diode Z912 to turn on, transistor T913 will remain hard off, and oscillator 70 will remain on until the voltage at node N9 is sufficiently negative for zener diode Z912 to turn on and current to flow through resistor R911, raising the voltage (reducing the absolute value) at node N9. The circuit reaches equilibrium when current through transistor T961 is equal to current through resistor R911.

It can be seen that when both transistors T912 and T913 are on, the base of transistor T913 is at approximately zero volts since the base of transistor T912 is one base-emitter drop above ground and the base of transistor T913 is one base-emitter drop below the base of transistor T912.

If the duty cycle to transistor T961 were 100%, that is if transistor T961 were on 100% of the time, the 2.5 volt level provided by zener diode Z961 would produce a current through resistors R961 and R962, which have a total resistance of 30.8k ohms, of about 80 microamps. If node N9 is not sufficiently low for zener diode Z912 to turn on, voltage to the base of transistor T913 will increase, turning off transistor T913 and holding oscillator 70 on, until the voltage on node N9 goes sufficiently negative to turn on zener diode Z912, whereupon equal current flows through resistor R911 to node N9. Since the circuit will stabilize when the base of transistor T913 is at approximately zero volts, the 80 microamp current through 100k ohm resistor R911 puts the voltage on the cathode of zener diode Z961 at approximately −8 volts.

If the duty cycle to transistor T961 were zero, that is if transistor T961 were always off, the 2.5 volt level on zener diode Z961 would not be provided to the base of transistor T913 and there would be no resulting current flow through resistor R911 with resulting voltage drop at the cathode of zener diode Z912. The voltage at the cathode of zener diode Z912 would be equal to that on the base of transistor T913.

For a row voltage having a nominal value of 16 volts an 8 volt adjustment gives ±20% around the nominal value. Duty cycle provided to transistor T961 can usually vary between 5% and 95%. The voltage at node N9 must be adjustable ±10% for temperature variation in the threshold voltage of the liquid crystal material and there must be another ±5% adjustment for tolerance of various components in the circuit. Therefore in a preferred embodiment contrast adjustment circuit 60 will provide for a voltage adjustment of ±15%. Component values shown in FIG. 9 can be adjusted to provide for that.

Figure 3:
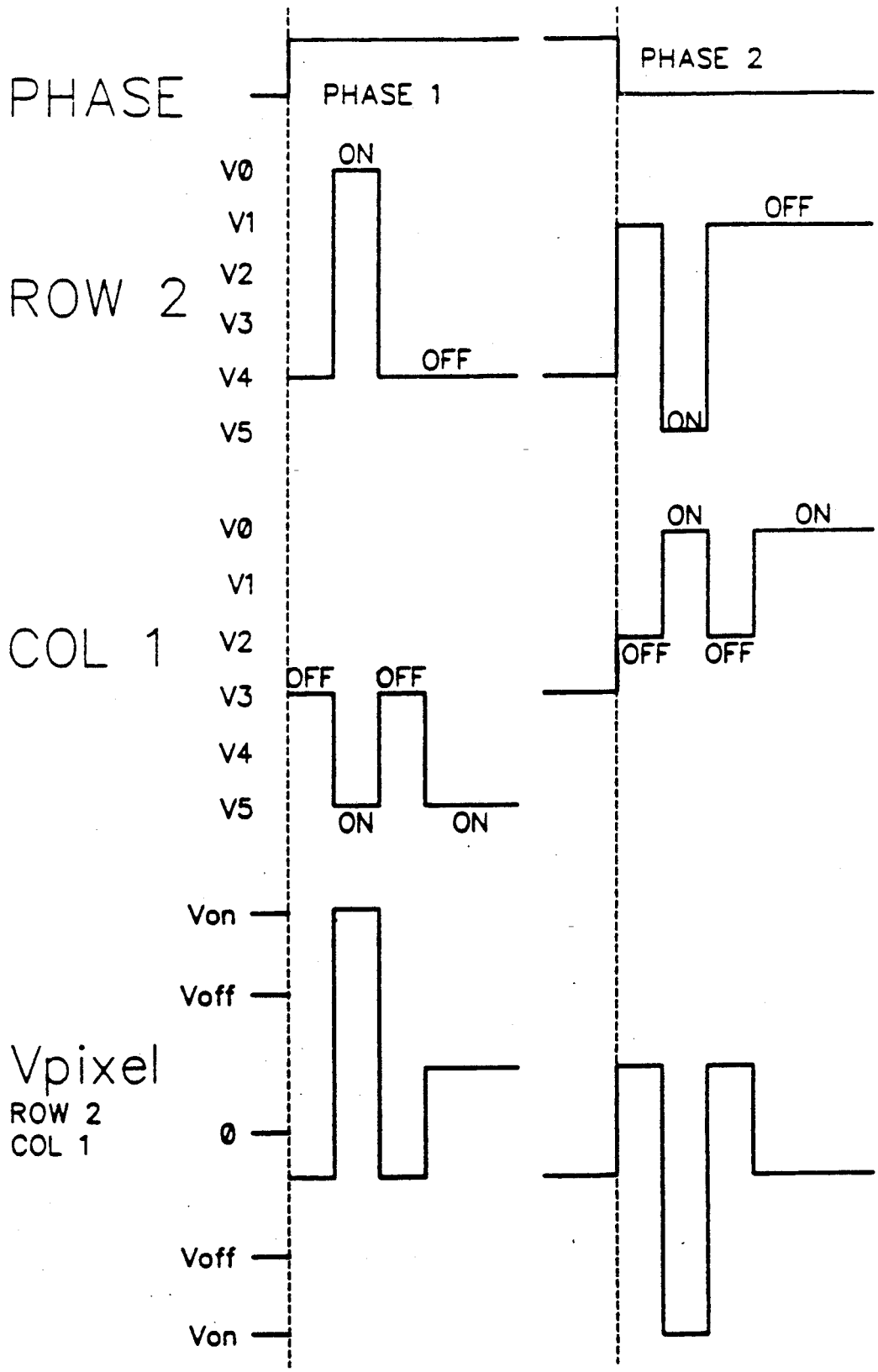
FIG 3 PRIOR ART
FIG. 3 shows a timing diagram for one prior art method of driving a liquid crystal display and the resultant waveform seen by one pixel in the display.
Figure 4B:
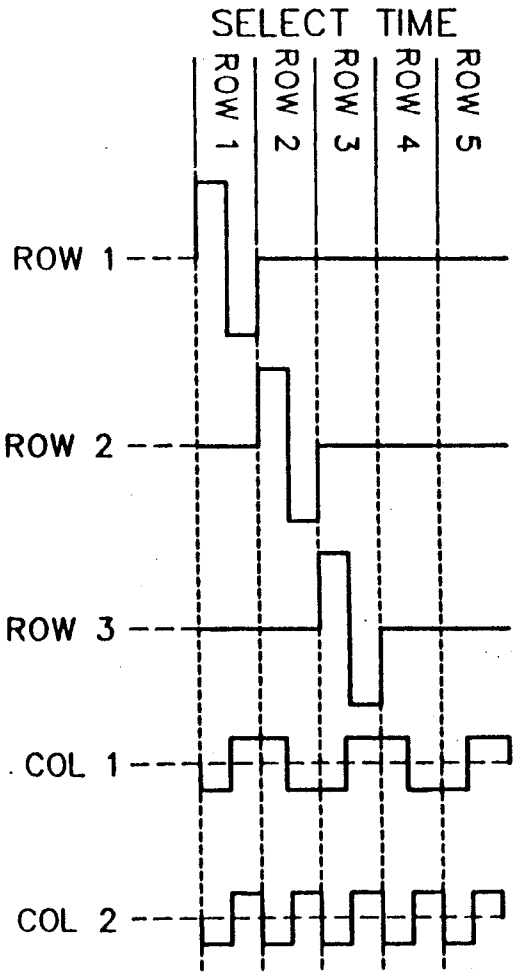
FIG 4B PRIOR ART
Figure 4A:
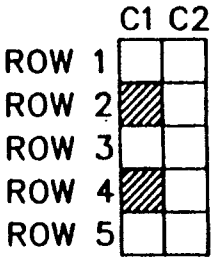
FIG 4A PRIOR ART

The circuit of FIG. 9 achieves both proper RMS voltage to pixels and zero average DC voltage to the pixels using only three voltages (with respect to a reference voltage), as was done with FIG. 8. The circuit of FIG. 9 can use these three voltages to supply voltage levels to existing devices such as Seiko SED 1600 DAA and SED 1631 DAA chips which expect five voltage levels as discussed above in conjunction with FIGS. 3 and 6.

As shown in FIG. 9, the phase reverse signal is provided to phase reverse circuit 50 and to row driver R90 and column drivers C90*a* and C90*b*.

Phase at logical 1

When the phase reverse signal is logical 1, switch S951 causes the voltage at node N9 (approximately −16 volts in the example discussed above) to be applied to VREF and the V+COL voltage to be applied through diode D951 to lines V2 and V3, one of which is applied by odd column driver C90*a* to odd columns and one of which is applied by even column driver C90*b* to even columns. (It is preferred to provide physically separate drivers for odd and even columns so that the odd and even columns can be connected at opposite sides of the display, thus allowing more generous tolerance in the line spacing.) Application of node N9 voltage to VREF makes the voltage level on V−COL approximately −16 volts −1.6 volts or −17.6 volts. Seiko requires that the voltage on V5 of the Seiko SED1600DAA chips be at least 8 volts below the positive supply voltage. Node N11 is pulled down to one diode drop above the lower of V−COL or N9 through diodes D952 and D953. Here, the most negative voltage is the voltage on V−COL. Thus, when the phase reverse signal is a logical 1, the voltage on V5 is approximately 22.4 volts below the 5 volt positive supply voltage. Diodes D952 and D953 are needed to isolate the voltage on node N9 from the voltage on V−COL.

While the PHASE REVERSE signal is a logical 1, switch S951 applies the voltage on node N9 to VREF. Switch S951 simultaneously connects V0 to V2 and V3. The logical 1 PHASE REVERSE signal also causes column drivers C90*a* and C90*b* to apply the voltages on V2 and V3 to those columns for which pixels in the selected row are to be ON, and to apply the voltage on V0 to those columns in which pixels in the selected row are to be OFF. The selected row receives ground voltage (zero volts) as applied by row driver R90 (to be explained further in connection with FIG. 10). Unselected rows receive V−ROW as provided by node N9, which is also connected to VREF. Therefore in the logical 1 phase, the row side of a pixel receives ground when selected and approximately −16 volts when not selected. The column side of an ON pixel receives approximately −17.4 volts whether selected or not. The column side of an OFF pixel receives approximately −14.6 volts. Thus the absolute value of the voltage across an ON pixel when selected is approximately 17.4 volts and the absolute value of the voltage across an OFF pixel when selected is approximately 14.6 volts. The absolute value of the voltage across both OFF and ON pixels when unselected is approximately 1.4 volts.

Phase at logical 0

When the phase reverse signal is a logical 0, VREF is connected to ground and V−COL is connected through diode D954 to V2 and V3. When VREF is connected to ground, making V−COL approximately −1.6 volts, the most negative voltage is the voltage on node N9. The voltage on V5 is pulled down by node N9 (−16 volts) through diode D953 to approximately −20.8 volts below the 5 volt positive voltage supply, an acceptable value for proper operation of the particular part being used. The voltage on V2 and V3 is provided by V−COL (−1.6 volts) through diode D954 to be approximately −1.4 volts. The voltage on V0 as provided by V+COL (+1.6 volts) through diode D951 is approximately +1.4 volts. The logical phase signal applied to row driver R90 causes the −16 volt V−ROW voltage on node N9 to be applied to the selected row, and ground (zero volts) to be applied to the unselected rows. The voltage on V0 is applied to columns in which pixels in the selected row are to be ON and the voltage on V2 and V3 is applied to columns in which pixels in the selected row are to be OFF. Therefore, the row side of a pixel to be ON receives −16 volts when selected and the column side receives +1.4 volts, for a voltage difference of 17.4 volts. The row side of a pixel to be OFF receives −16 volts when selected and the column side receives −1.4 volts for a voltage difference of 14.6 volts when selected. All unselected pixels receive a voltage difference of 1.4 volts.

Resultant DC Balance

Since the magnitudes of the voltages is precisely the same during the two phases, current drawn by the two secondary windings S982 and S983 will be equal, and the voltage can be regulated to give good picture quality for all kinds of images. Additionally, because the two phases are employed for equal amounts of time the resultant DC voltage across the pixels will be zero, resulting in long life for the liquid crystal display.

As was discussed earlier, the RMS voltage difference which controls whether a pixel is ON or OFF is determined during the brief time the row in which the pixel is located is selected. If the row and column voltages during the select time have opposite phases, the voltage difference will be large and the pixel will be ON. If the row and column voltages have the same phase during the select time, the pixel will be OFF. Voltage to a pixel is applied during two opposing phases in order to produce a resultant DC voltage to the pixel of 0 volts. When the phase reverses, all applied voltages to rows and columns change polarity. The circuit of FIG. 9 accomplishes this result by generating a high voltage across primary winding P981 which provides the row select voltage and generating two low voltages across secondary windings S982 and S983. The voltage at node N9 is on the order of −16 volts as controlled by zener diodes D914 and D915.

Operation of Row and Column Drivers Shown in FIG. 10

FIG. 10, comprising sections 10-1, 10-2, and 10-3, shows the row and column driver portion M9 of FIG. 9 in more detail. In FIG. 10, the means for generating row and column voltages are shown in less detail. Corresponding elements shown in both figures have the same reference numerals in the two figures.

Row and column driver circuit M9 comprises eight column shift register chips CSR1 through CSR8 and three row shift register chips RSR1 through RSR3.

The three row shift registers RSR1 through RSR3 are Seiko parts SED 1600DAA and determine which is the selected row by placing the signal received on one of lines V0 and V5 on the selected one of 201 row lines (not shown) and placing the signal received on line V4 (or V1) on the remaining row lines. The PHASE REVERSE signal controls which of the signals on V0 and V5 is provided to the selected row. The high FRAME SYNC signal is applied to the DI pin (which is connected to the row 1 output line) of row shift register RSR1 by the external FRAME SYNC line. This causes row 1 to become selected On every cycle of the ROW CLOCK signal, the bank of row shift registers RSR1 through RSR3 shifts the high signal applied by the FRAME SYNC line to the next row. The first two row shift registers control 80 rows. Row shift register RSR3 controls 41 rows in this 201 row embodiment When the high signal reaches row 80 of row shift register RSR1, a connecting line applies the signal to row 1 of row shift register RSR2. By this means the high signal propagates along all rows in the display, causing each successive row to become selected for one ROW CLOCK cycle.

The eight column shift registers CSR1 through CSR8 are Seiko parts SED1631DAA. In the 640 column embodiment shown in FIG. 10, the COLUMN CLOCK must cycle 640/8 or 80 times as fast as the row clock. The COLUMN CLOCK cycles at 800 kHz and the ROW CLOCK at 10 kHz. On every COLUMN CLOCK cycle, an 8-bit data bus provides on line CDO four bits to one of shift registers CSR1, CSR3, CSR5 and CSR7 which drive odd numbered columns, and simultaneously on line CDE four bits to one of shift registers CSR2, CSR4, CSR6 and CSR8 which drive even numbered columns interleaved with the odd numbered columns. On subsequent clock pulses, data are shifted toward their positions. Thus the column data are loaded into the 4-bit wide even and odd column drivers one 8-bit byte at a time. Column shift registers CSR1 through CSR8 include buffers for storing the received data, then shifting the 320 even and 320 odd columns of data simultaneously onto the 640 columns in response to the ROW CLOCK signal. In an embodiment in which phase is reversed every row in the mid-part of a row time, the phase reverse signal may be generated from a pin of one of the column shift registers which indicates that shift register is beginning to be loaded.

The system of FIG. 10 allows a display to be driven using signals from a simple counter chain to synchronously generate timing signals and sequential RAM addresses. The addressed RAM data unload directly from an 8-bit RAM data bus providing data from a display bit map B101 organized in 32K bytes of 8 bits each to two banks of commercially available 4-bit-wide column driver chips (i.e. SED1631DAA).

As can be seen in FIG. 10, even and odd columns of the display D101 are driven from opposite sides of the display 101, eight consecutive columns being driven from data in a single byte from bit map B101. The four even bits are sent to one of 4-bit column drivers CSR2, CSR4, CSR6, and CSR8 physically located at the bottom of the display and the four odd bits are sent to one of 4-bit column drivers CSR1, CSR3, CSR5 and CSR7 physically located at the top of the display. Even column lines driven from the bottom of the display D101 are interlaced with odd column lines driven from the top of display D101. By this means, a more generous line width tolerance can be achieved using standard parts and no multiplexing or demultiplexing to divide the eight bits into two separate four bit portions for applying to the two 4-bit column drivers is necessary.

FIG. 10 shows a first column clock loading signals into column shift registers CSR7 and CSR8 for shifting into their successive registers. The figure shows signals V0, V2, V3, V5, VDD, VSS, and the first column clock, phase reverse, row clock and odd or even data lines connected to column shift registers CSR7 and CSR8. In a preferred embodiment, all signals except the first column clock signals are actually applied to all four odd column shift registers for odd columns and all four even shift registers for even columns, but are not shown for simplicity. The first column clock is applied to column shift registers CSR5 and CSR6 as well as CSR7 and CSR8.

FIG. 10 shows a second column clock indicated with dotted lines. This second column clock applies a clock signal to column shift registers CSR1 through CSR4. Both column clock signals are taken from the same 800 kHz source It takes 80 successive clock cycles to shift data into position As described in the Seiko data book SMOS SYSTEMS, 1988/89 CMOS DATA BOOK, copyright 1988, for Seiko column shift registers SED1631/DAA, with each clock cycle a "token" is passed through each shift register as the data are loaded into that shift register. After 20 clock cycles, when the token is passed to the next shift register, the data applied to the next shift register begin to be loaded into that shift register. This token passing saves the power that would be consumed by shifting all data through the full length of shift registers. However, even when the token is not in a shift register and the shift register is not being loaded with data, that shift register consumes some power responding to the clock signal. The total power consumed by the shift registers can be reduced by using more than one clock signal, and applying clock signals to only some of the shift registers at a time. For example, four clock signals can be provided, and each shift register clocked only while the token is in that shift register. In the presently preferred embodiment, to reduce the number of pins required to provide clock signals, only two separate clock signals are provided. The first clock signal drives shift registers CSR5 through CSR8 which load the first 40 bytes of data during the first 40 clock cycles, and the second clock signal drives shift registers CSR1 through CSR4, which load the second 40 bytes of data during the second 40 clock cycles. Turning off the clock pulse to half of the shift registers while they are not being loaded has been found to save significant power.

Simultaneous Use of Bus for Loading RAM and Driving Display

There is a display bit map RAM which stores data for being presented to each of the pixels of the display as discussed in co-pending application Ser. No. 07/374,884, ibid. A data bus allows signals from this RAM to be sent to the column drivers for unloading the RAM data to column lines. This same data bus may also be used for loading data into this display bit map RAM under the control of a microprocessor. The microprocessor sends appropriate write signals and address signals and applies data to this data bus for storing in the RAM. Unloading of data from the RAM to the column drivers is done under control of the column clock shown in FIG. 10 and is not stopped when data is being loaded into the RAM by the computer. However, the entire display RAM can be loaded in a period on the order of 20 to 30 milliseconds and this time is shorter than the response time of the liquid crystal material so there is no visible effect on the display from the signals from the computer to the display bit map RAM also being presented to the column drivers. Loading the eight data bits this way eliminates the need for a general purpose microprocessor or even any circuitry for converting 8 parallel bits to two sets of 4 parallel bits Power savings result from the reduced number of reads necessary to read the data 8 bits at a time rather than 4, and from running the clock at a lower speed.

Power Saving

Power which comes from the V+COL, V−COL, and V−ROW supply lines is dissipated by the $I^2R$ losses of the interconnect lines and the switching transistors of the row and column drivers. However, power is proportional to capacitance, the square of the voltage, and frequency $$P=CV^2F$$

In this case, frequency is the frequency of pixel voltage reversal Frequency of switching transistors for the 8 selected memory cells which receive and shift column data is 800 kHz However, frequency of switching the 640 transistors which apply a new signal voltage to a column line is between 5 kHz and 10 kHz for the first phase reversal timing described above, as determined by the 5 kHz phase shift which occurs every row time and by any changes in data applied to one column line from one row time to the next. By shifting phase only mid-row as discussed in connection with FIGS. 5*a*, 5*b*, and 5*c*, the switching frequency is thereby reduced, and the power consumption is accordingly reduced. Frequency is 0 to 5 kHz for a second phase reversal timing to be discussed below, and 1.25 to 6.25 kHZ for a third phase reversal timing to be discussed below.

Image Quality

Since current supplied by capacitor C911 increases as the number of ON pixels increases, and current supplied by capacitors C982 and C983 increases as the number of reversals from an OFF pixel to an ON pixel (or ON to OFF) in adjacent columns increases, for images where most pixels are OFF, the currents supplied by these three capacitors C911, C982, and C983 track each other approximately as the number of ON pixels increases. For an image having a higher number of ON pixels the higher current provided by the capacitors causes the voltage across all three capacitors to decrease. As shown in FIGS. 8 and 9, a regulating reference voltage VREF is used to control the on-time of the switching transistor of the primary coil. In FIG. 8 this switching circuit is labeled 20 and the primary coil is P81. The switching transistor in FIGS. 9 and 10 is T913, and the primary coil is P981.

The circuits of FIGS. 8 and 9 are particularly advantageous in drawing from the three capacitors C81, C82 and C83 (FIG. 8) or C911, C982 and C983 (FIGS. 9 and 10) currents which track each other, because voltages provided on the three capacitors will retain a constant ratio and the voltages to the display can be regulated precisely enough that display image contrast will remain good quality for a wide variety of images. Tracking is superior to that which would occur for a switching regulator circuit used with a method in which phase is reversed at both the middle and the end of every row time (taught by Hughes). With Hughes, in most practical applications an increase in the number of ON pixels produces an increase in current drawn by the row driver and a decrease in current drawn by the column driver (accompanying a decrease in the number of reversals from one row to the next). Lack of current tracking between the three capacitors when phase reversal occurs at both the middle and the end of a row time means that the relative voltage provided by the three capacitors varies from one kind of image to another and, though workable, using the switching regulator of FIG. 8 or 9 with the phase reversal method of Hughes will produce a degradation of image contrast.

Alternative Scan Routines having Different Phase Reversal Times

Since the PHASE REVERSE signal causes the polarity of all signals to rows and columns to switch polarity, application of the PHASE REVERSE signal may be made at a variety of points in time with respect to the application of a ROW CLOCK signal or COLUMN CLOCK signal. Thus the drive system of FIGS. 9 and 10, and the drive system of FIG. 8 can accommodate more than one scan routine such as discussed with respect to FIGS. 5*a*, 5*b*, and 5*c*. The PHASE REVERSE, ROW CLOCK, and FRAME SYNC signals for any of the scan routines may be generated by picking points from a digital counter or shift register which is synchronized with the data clock, using conventional logic design techniques.

Timing of Phase Reversal for Second Scan Routine

Figure 12:
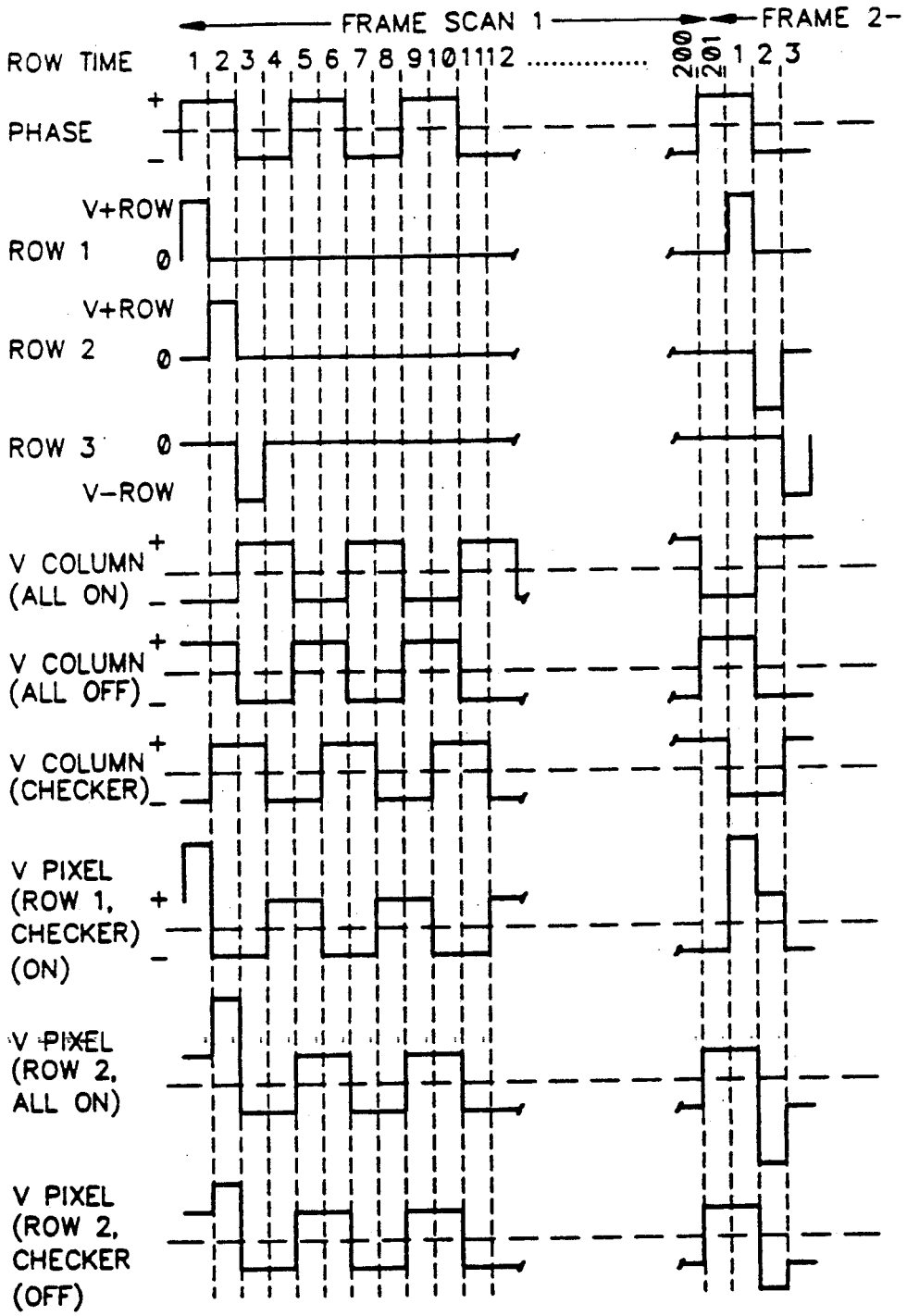
FIG. 12 shows a timing diagram for a second scan routine embodiment in which voltages are driven by the circuit of FIG. 8.

FIG. 12 shows a timing diagram for a second scan routine embodiment (the first scan routine embodiment was described in conjunction with FIGS. 5*a*, 5*b*, and 5*c*) in which row and column voltage are driven by the circuit of FIG. 8. According to this second scan routine, the polarity of voltage across the pixels of the selected row (which we call the phase) is reversed every two row times. The line labeled PHASE indicates polarity of voltage across the pixels of the selected row as a function of time. In FIG. 12, row times (the row time is the time when the numbered row is selected) for a portion of an embodiment having 201 rows in a frame are shown. The line labeled ROW1 shows that during row time 1 a positive voltage, V+ROW, is applied to ROW1, and that during the remaining unselected times during FRAME SCAN 1 for ROW1, a zero volt signal is applied to ROW1. Two positive pulses are shown, for two successive frame scans. During the second frame scan, at row time 1, ROW1 receives V+ROW. As shown in the line labeled ROW2, during frame scan 1, a positive voltage, V+ROW, is applied to ROW2 during row time 2 of frame scan 1 and a negative voltage, V−ROW is applied during row time 2 of frame scan 2. This offset between successive frame scans occurs because the phase reversal cycle is four row times and for the illustrated embodiment having 201 rows, divisible by four with a remainder of one, the cycle will shift by one row time every scan. As can be determined from observing the applied row voltage for the first three rows, the row voltage during the time the row is selected has a polarity indicated by the PHASE line. The timing of the row pulse matches the row time number indicated in the row time line.

Voltage applied to each column at a particular row time depends upon the intended state of the pixel at the intersection of the column and the selected row. The line labeled "Column (all on)" shows the voltage waveform to a column in which all pixels are to be ON. This waveform is seen to be 180° out of phase with the PHASE line during all row times. The next line labeled "Column (all off)" shows that the voltage to a column in which all pixels are to be OFF is in phase with the PHASE line during all row times. During all frame scans, Column (all on) is out of phase with the PHASE line and Column (all off) is in phase with the PHASE line The next line labeled "Column (checker)" shows the voltage waveform to a column in which pixels alternate from OFF to ON, as they would in a checkerboard. This line is offset by 90 degrees in phase from the PHASE line but has the same frequency of phase reversal as the solid colors. Thus a checkerboard pattern does not alter the frequency of phase reversal.

As can be seen by the next line, labeled "Pixel (ROW1, checker)", a high positive voltage is applied during row time 1 to the pixel in row 1 at the intersection with the checkered column. This high voltage during row time 1 is sufficient to cause the pixel to adopt the ON color. Likewise, in the next line labeled "Pixel (ROW2, all on)" the high voltage difference between row and column voltages at row 2 time will cause this particular pixel to be ON. The last line, labeled "Pixel (row2, checker)", which shows that the voltage applied to the pixel at the intersection of row2 and the checker column during row 2 select time is lower in magnitude, will cause this pixel to be OFF.

The scan routine of FIG. 12, which reverses phase every two row times at the end of a row time (or which cycles in phase every four row times), produces a constant frequency of phase reversal for a constant color image of either color, and for an image in which color in a column changes every row. It can be seen that for the scan routine of FIG. 12, a change of one bit will not change the frequency of phase reversal. Some patterns will produce a change of frequency over the period of time equal to one frame scan. The change of frequency will be in the opposite direction for the next frame scan, therefore over the time of two frame scans the integrated frequency is constant for all images, resulting in a constant threshold voltage for the liquid crystal display. If the time constant of the circuit (the time for the circuit to adjust voltage in response to a changing column voltage) is short enough, the display quality will be excellent. However, over a single frame scan, the routine of FIG. 12 will allow voltage applied to the pixels to vary in frequency from 0 to 5 kHz. The frequency of phase reversal can go to zero for an image which has the same pattern as the phase reverse timing diagram. The disadvantage of the every-two-row scan routine of FIG. 12 is that the power supply has a short time constant and responds to the frequency averaged over less than a single frame. It cannot produce constant voltage for such a wide frequency variation.

For example, in FIG. 8, a zero frequency phase reversal will mean that one of capacitors C82 and C83 will be discharged, and one of diodes D82 and D83 will become back biased. But current cannot be driven backward through one of the column diodes during half of a phase time, therefore this column driver cannot apply the proper voltage to its side of the pixels, making a totally unacceptable display quality. The 20-millisecond frame scan time is long enough to alter voltage to the display for the circuit of FIG. 8. To allow for a zero frequency phase reversal over the span of one frame scan requires that the circuit of FIG. 8 be modified to put a load on the output of the column drivers. Adding such a load uses additional power, which is undesirable.

Timing of Phase Reversal for Third Scan Routine

Figure 13:
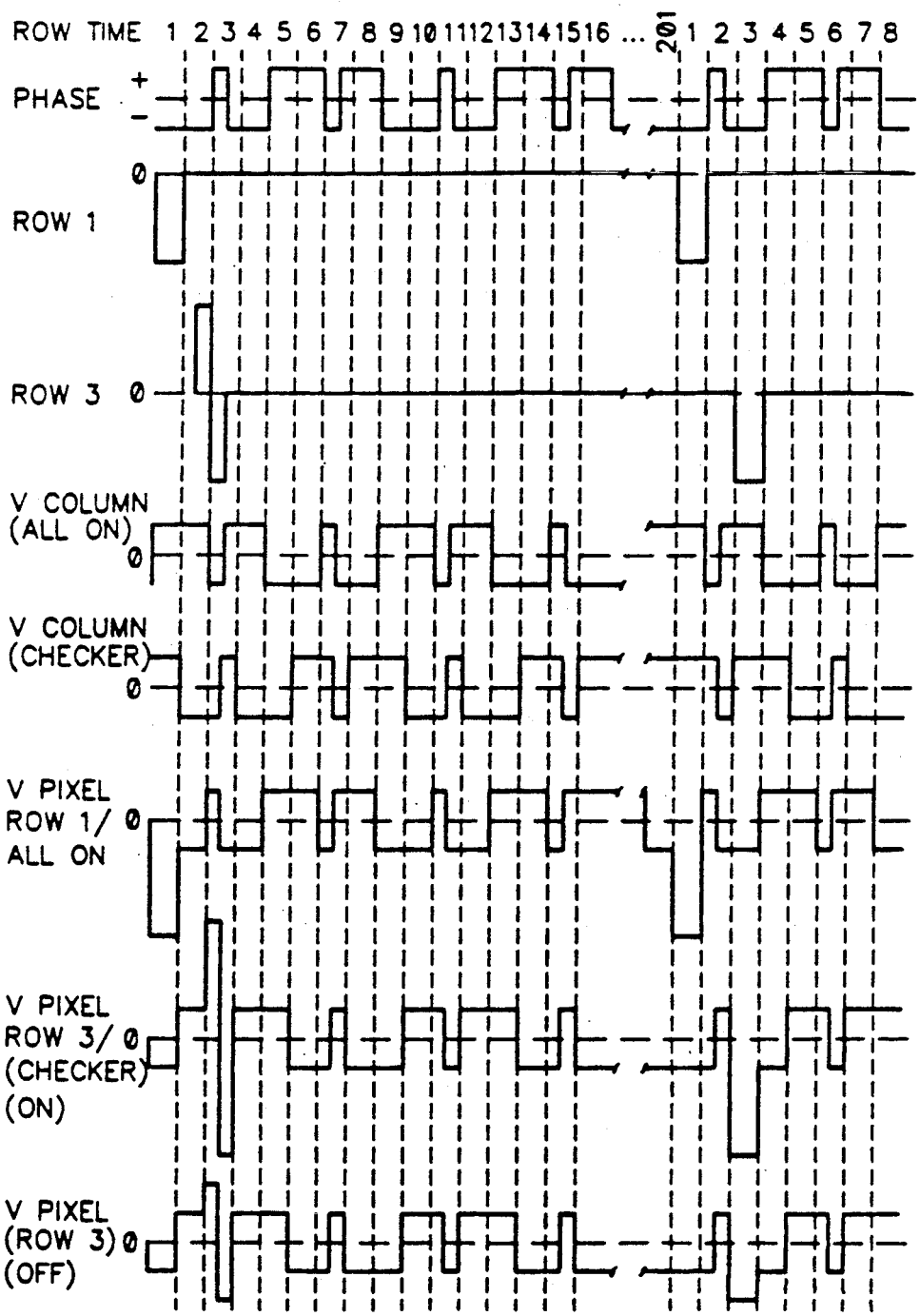
FIG. 13 shows a timing diagram for a third scan routine embodiment in which voltage are driven by the circuit of FIG. 8.
Figure 14:
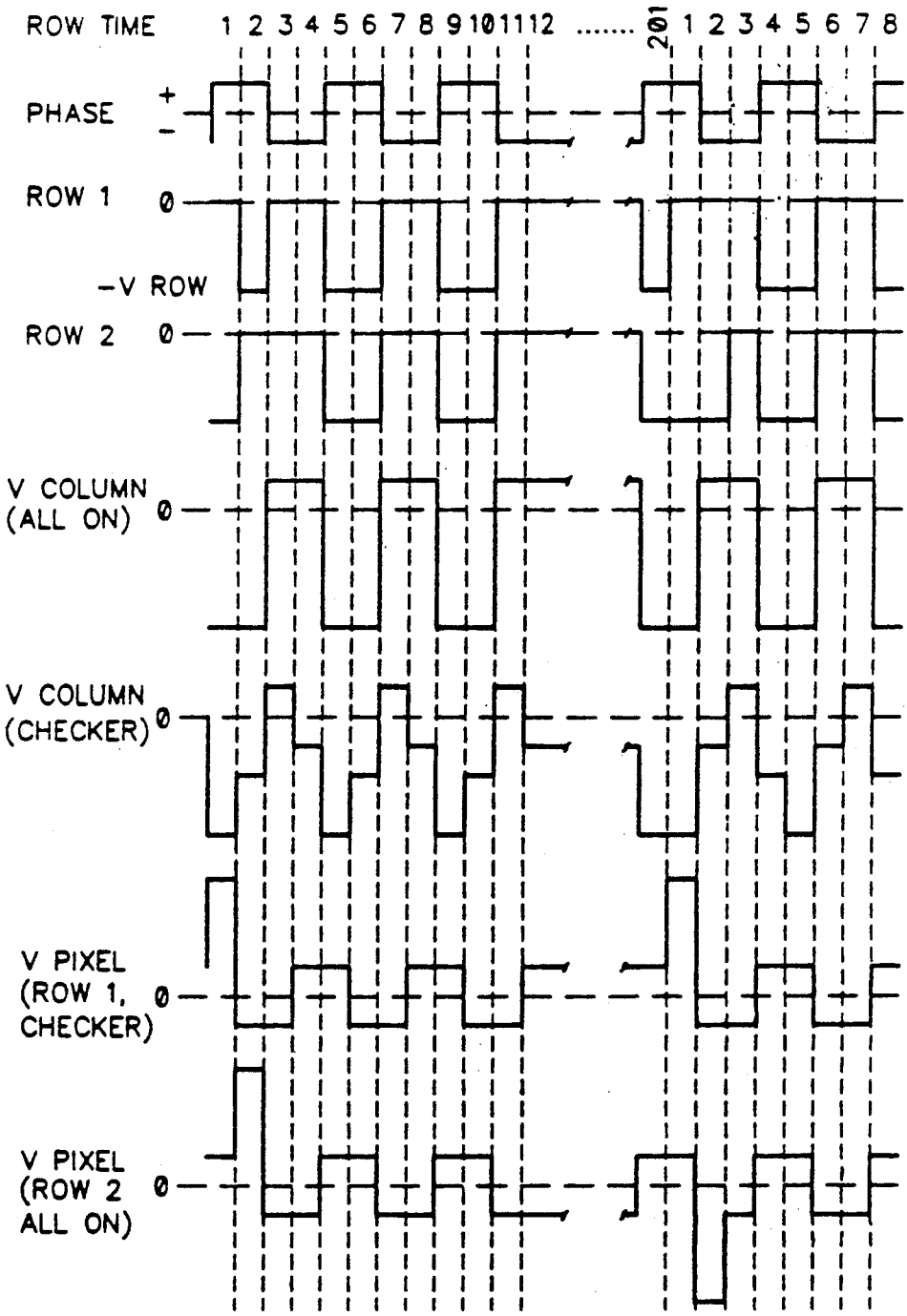
FIG. 14 shows a timing diagram for the second scan routine embodiment in which voltages are driven by the circuit of FIG. 9.

A third scan routine illustrated in FIG. 13 also does not change the phase reverse frequency with a single bit change. This third scan routine does change the frequency of phase reversal for certain patterns, as was the case with the first and second methods, but as with the second scan routine of FIG. 12, the frequency of phase reversal as integrated over two frame scans is constant for all images, thus the threshold voltage of the display will not vary significantly due to frequency. With this third method, some phase reversals occur mid-row and thus the frequency of phase reversal averaged over one frame can never go to zero. This scan routine has a range in frequency of phase reversal for a single frame from 1.25 to 6.25 kHz. This gives an average over 2 frames of 3.75 kHz for all images. With this scan routine it is not necessary to load the column driver output to protect the power supply. The operation of the scan routine of FIG. 13 can be understood from comparing FIG. 13 to FIG. 12, which has been described in detail above. Thus the operation of FIG. 13 will not also be described in detail.

Regarding the second scan routine shown in FIG. 12, one means of loading the column driver output without wasting power is to use the column driver output voltage for driving the logic for the columns.

Comparison of Three Scan Routines

If keeping frequency constant over a shorter time interval is important, the first scan routine may be preferred. The first scan routine keeps the power supply voltage the most nearly constant when using the method of this invention which generates three supply voltages. However, the first scan routine does not give a guaranteed constant phase reversal frequency over two frame scans and thus contrast may vary due to cross talk effects and threshold voltage shifts of the liquid crystal display material. The second scan routine of FIG. 12, though low in power, would require a load to keep a constant voltage to the display, and this may not be practical. The third scan routine may be preferred for some applications. The preferred embodiment is a function of the application.

Several embodiments and advantages of the present invention have been described. In light of this description, other embodiments and advantages will become obvious to those skilled in the art. The scope of the invention is not limited to those embodiments described in detail.

It is clear that other numbers and sizes of shift registers can be used and that other options may be present on shift registers selected for other applications. Other voltages will be used for crystals having other threshold and transition voltages.

We claim:

1. A scan controller for a liquid crystal display comprising:

means for generating a row voltage between positive and negative row voltage nodes;

means for generating a first column voltage at a first column voltage node positive with respect to a reference voltage;

means for generating a second column voltage at a second column voltage node negative with respect to said reference voltage;

means for connecting one of said reference voltage node, said first column voltage node or said second column voltage node to one of said positive row voltage node or said negative row voltage node and thereby generating a pixel voltage difference to be applied across a pixel.

2. A scan controller as in claim 1 in which said liquid crystal display has a number N of row lines, each of which is selected for one of said row times, said row voltage and said first and second column voltages having magnitudes VROW and VCOL respectively such that an OFF RMS voltage across a pixel results from the formula $$\underset{\text{voltage}}{\overset{\text{OFF}}{RMS}} = \sqrt{\frac{(VROW - VCOL)^2 + (N-1)(VCOL)^2}{N}}$$

and an ON RMS voltage across a pixel results from the formula $$\underset{\text{voltage}}{\overset{\text{ON}}{RMS}} = \sqrt{\frac{(VROW - VCOL)^2 + (N-1)(VCOL)^2}{N}}$$

and said liquid crystal display has a threshold voltage which is the highest voltage at which liquid crystal material in said display is acceptably OFF and a transition voltage in which said threshold voltage plus said transition voltage is the lowest voltage at which said liquid crystal material is acceptably ON, said OFF RMS voltage being selected to be less than or equal to said threshold voltage and said ON RMS voltage being selected to be greater than or equal to said threshold voltage plus said transition voltage.

3. A scan controller as in claim 1 in which an ON pixel is transmissive and an OFF pixel is absorbent.

4. A scan controller as in claim 1 in which an OFF pixel is transmissive and an ON pixel is absorbent.

5. A scan controller as in claim 1 further comprising means for generating a phase signal which switches said one of said fist column voltage node, said second column voltage node and said reference node between said positive and negative row voltage nodes at a point other than the end of a row time for each of said rows, a row time being the time during which a row is selected.

6. A scan controller as in claim 5 in which said point other than the end is the midpoint of said row time.

7. A scan controller as in claim 1 in which a phase signal switches between first and second polarities every other row time at the end of a row time.

8. A scan controller as in claim 1 in which a phase signal switches between first and second polarities six times within eight row times, first and fourth switchings occurring in the middle of a row time and remaining switchings occurring at the end of a row time.

9. A scan controller as in claim 1 in which said means for generating a row voltage and said means for generating a first column voltage and a second column voltage are controlled by voltage feedback means which turn off said means for generating in response to excess voltage generated by said means for generating said first or second column voltage.

10. A scan controller as in claim 1 in which said means for generating a row voltage and said means for generating a first column voltage and a second column voltage are controlled by voltage feedback means which turn off said means for generating in response to excess voltage generated by said means for generating a row voltage.

11. A scan controller as in claim 9 or 10 in which said means for generating a row voltage comprises:

a primary coil connected at one end to a first voltage supply and connected at the other end through a switching means to a second voltage supply, said switching means being controlled by said voltage feedback means; and a first secondary coil driven by said primary coil, said first secondary coil forming a first loop with a first diode and a first capacitor having a first plate and a second plate, said first capacitor providing said row select voltage.

12. A scan controller as in claim 11 in which said means for generating a first column voltage and a second column voltage comprises:

said primary coil;

a second secondary coil forming a second loop with a second diode and a second capacitor having a first plate and a second plate; and a third secondary coil forming a third loop with a third diode and a third capacitor having a first plate and a second plate;

said first plates of said second and third capacitors being connected together.

13. A scan controller as in claim 12 further including means for alternately connecting said first and second plates of said first capacitor to said first plates of said second and third capacitors, whereby equal loads are supplied by said second and third capacitors when averaged over the time one of said plates of said first capacitor is continuously connected.

14. A scan controller as in claim 13 in which:

said means for applying said row voltage successively for one row select time to a selected row of said rows and applying a reference voltage to the remaining rows comprises a row driver which connects that one of said first plate and second plate of said first capacitor not connected to said first plates of said second and third capacitors to said selected row line and connects the other of said first plate and said second plate of said first capacitor which is connected to said first plates of said second and third capacitors to remaining unselected row lines; and said means for applying said first column voltage to columns in which those pixels in said selected row are to be OFF and applying said second column voltage to columns in which those pixels in said selected row are to be ON comprises a column driver which alternately connects said second plates of said second and third capacitors to said OFF columns and said ON columns in response to said phase reverse signal.

15. A scan controller as in claim 10 in which said means for generating said row voltage is a primary coil having a driven end driven by an oscillator, and said voltage feedback means is a circuit which applies a voltage taken from said driven end of said primary coil through a voltage shifting means which shifts voltage by an amount equal to a desired row select voltage to a means for turning off said oscillator, said oscillator turning off when said voltage taken from said driven end exceeds said desired row select voltage and turning on when said voltage taken from said driven end does not exceed said desired row select voltage.

16. A scan controller as in claim 15 in which said desired row voltage can be adjusted by a contrast switching regulator, said contrast switching regulator turning on and off in response to control signals provided by a user.

17. A scan controller as in claim 1 in which the difference in magnitude between the first and second column voltages applied to a column driver which drives columns of said display is less than 10 volts.

18. A scan controller as in claim 1 where said first column voltage serves as the positive voltage supply for a column driver which drives columns of said display, said second column voltage serves as a negative voltage supply for said driver, and column data signals serve as input signals for said driver.

19. A scan controller as in claim 18 in which said first and second column voltages add to between 2.5 and 12 volts.

20. A scan controller as in claim 19 in which said column driver is CMOS.

21. A scan controller as in claim 1 in which said reference voltage is a fixed voltage with respect to a second reference voltage used by said data means.

22. A scan controller as in claim 1 in which said liquid crystal display has a first surface on which are arranged a plurality of conductive row lines and a second surface on which are arranged a plurality of conductive column lines approximately orthogonal to said row lines, and a plurality of pixels, each pixel being a portion of liquid crystal material situated between corresponding row and column lines, and a transmittance which depends upon the integrated voltage difference between said corresponding row and column lines; said scan controller comprising:

means for applying a select voltage in turn to each of said row lines, thereby designating a selected row, and simultaneously applying one of said first and second column voltages to each of said column lines.

23. A scan controller as in claim 22 further comprising:

means for generating a phase signal which switches between first and second polarities, the length of time occupied by said first and second polarities over two frame times being equal, a frame time being the time for scanning all of said row lines.

24. A scan controller as in claim 22 in which said second column voltage has a magnitude approximately equal to that of said first column voltage.

25. A scan controller as in claim 22 further comprising means for generating a select voltage, said select voltage being positive with respect to said reference voltage by an amount equal to said row voltage when said phase signal has said first polarity, and said select voltage being negative with respect to said reference voltage by an amount equal to said row voltage when said phase signal has said second polarity;

means for applying said select voltage to said selected row and a reference voltage to remaining unselected rows; and means for when said phase signal has said first polarity applying to columns for which pixels in said selected row are to be ON said second column voltage, and applying to columns for which pixels in said selected row are to be OFF said first column voltage; and when said phase signal has said second polarity applying to columns for which pixels in said selected row are to be ON said first column voltage, and applying to columns for which pixels in said selected row are to be OFF said second column voltage.

26. A scan controller for a liquid crystal display having pixels arranged in rows and columns, each pixel being controlled by a row line extending along a corresponding row near a first surface of said pixel and a column line extending along a corresponding column near a second surface of said pixel, comprising:

means for generating a row select voltage;

for each row of said rows, means for applying to said row line during a row select time a row line voltage which differs from a reference voltage by an amount equal to said row select voltage, and applying to remaining unselected rows said reference voltage;

means for generating a first column voltage having a polarity equal to that of said row line voltage and a second column voltage having a polarity opposite to that of said row line voltage; and means for applying to said column line in each of said columns said first column voltage when a pixel located in said column and said selected row is to be OFF and applying to said column line in each of said columns said second column voltage when a pixel located in said column and said selected row is to be ON;

said means for generating a row select voltage and said means for generating said first and second column voltages being controlled by a switching regulator.

27. A scan controller as in claim 26 in which said switching regulator comprises an oscillator including a primary coil which drives said means for generating said row select voltage and said means for generating said first and second column voltages, said oscillator including means for being turned on and off in response to a feedback signal from one of said row select voltage, said first column voltage and said second column voltage.

28. For a liquid crystal display having pixels, said pixels being arranged in rows and columns, each pixel having a reflectance which depends upon a voltage difference between a row line near a first surface of said pixel and a column line near a second surface of said pixel, a scan control method comprising the steps of:

sequentially selecting each of said rows of said pixels for a row select time;

generating a phase reverse signal, said phase reverse signal having a phase reverse polarity which switches between a positive polarity and a negative polarity after a time equal to said row select time, said phase reverse signal switching polarity at a time other than the end of each said row select time;

during each said row select time applying to said selected row a row select voltage having a polarity equal to said phase reverse polarity and applying to remaining unselected rows of said pixels a reference voltage;

applying to each column of said columns a column voltage having a polarity equal to said phase reverse polarity when a pixel in said each column and said selected row is to be OFF and applying to each column of said columns a column voltage having a polarity opposite to said phase reverse polarity when a pixel in said each column and said selected row is to be ON, whereby said column voltage switches polarity between adjacent row select times only when adjacent ones of said pixels in said each column are to be in different states.

29. For a liquid crystal display having pixels, said pixels being arranged in rows and columns, each pixel having a reflectance which depends upon a voltage difference between a row line near a first surface of said pixel and a column line near a second surface of said pixel, a scan control method comprising the steps of:

sequentially selecting each of said rows of said pixels for a row select time;

generating a phase reverse signal, said phase reverse signal having a phase reverse polarity which switches between a positive polarity and a negative polarity after a time equal to two of said row select times, said phase reverse signal switching polarity at the end of a row select time;

during each said row select time applying to said selected row a row select voltage having a polarity equal to said phase reverse polarity and applying to remaining unselected rows of said pixels a reference voltage;

applying to each column of said columns a column voltage having a polarity equal to said phase reverse polarity when a pixel in said each column and said selected row is to be OFF and applying to each column of said columns a column voltage having a polarity opposite to said phase reverse polarity when a pixel in said each column and said selected row is to be ON.

30. For a liquid crystal display having pixels, said pixels being arranged in rows and columns, each pixel having a reflectance which depends upon a voltage difference between a row line near a first surface of said pixel and a column line near a second surface of said pixel, a scan control method comprising the steps of:

sequentially selecting each of said rows of said pixels for a row select time;

generating a phase signal, said phase signal having a first polarity which switches between a positive polarity and a negative polarity six times within an even number of row select times, switching from negative to positive polarity once at a time other than the end of a row select time and twice at the end of a row select time, and switching from positive to negative polarity once at a time other than the end of a row select time and twice at the end of a row select time;

during each said row select time applying to said selected row a row select voltage having a polarity equal to said phase polarity and applying to remaining unselected rows of said pixels a reverse voltage;

applying to each column of said columns a column voltage having a polarity equal to said phase polarity when a pixel in said each column and said selected row is to be OFF and applying to each column of said columns a column voltage having a polarity opposite to said phase polarity when a pixel in said each column in said selected row is to be ON.

31. A scan controller method as in claim 28, 29, or 30 in which said row select voltage has a magnitude at least twice the magnitude of said column voltage.

32. A scan controller method as in claim 28, 29, or 30 in which said row select voltage has a magnitude no more than forty times the magnitude of said column voltage.

33. A scan control method as in claim 28, 29, or 30 further comprising the step of feeding back a voltage related to said column voltage to a means for controlling said column voltage and said row select voltage.

34. A scan control method as in claim 28, 29, or 30 further comprising the step of feeding back a voltage related to said row select voltage to means for controlling said column voltage and said row select voltage.

35. A voltage regulator for generating voltages used for driving a liquid crystal display, comprising:

at least two coils, a secondary coil which is driven by a primary coil;

one of said two coils generating a voltage applied across a capacitor which provides a voltage to be used for feedback for controlling said voltages;

means for providing alternating current through one of said coils;

a switch for turning on and off said means for providing alternating current through said one of said two coils;

control means for controlling said switch, said control means being a voltage directly related to said voltage to be used for feedback;

whereby said switch turns off said means for providing alternating current when said voltage to be used for feedback exceeds the desired voltage level by more than the tolerated error and said switch turns on said means for providing alternating current when said voltage to be used for feedback is less than said desired voltage level by more than another tolerated error.

36. A voltage regulator as in claim 35 where said primary coil is driven by said means for providing alternating current and said primary coil also provides said voltage to be used for feedback.

37. A voltage regulator as in claim 36 further comprising at least a third coil.

38. A voltage regulator as in claim 35 where said primary coil is driven by said means for providing alternating current and said secondary coil provides said voltage to be used for feedback.

39. A voltage regulator as in claim 38 further comprising at least a third coil.

40. A voltage regulator as in claim 35 in which said means for providing alternating current is an oscillator and said switch is a bipolar transistor which turns off said oscillator.

41. A voltage regulator as in claim 35 in which said voltage directly related to said voltage to be used for feedback is said voltage to be used for feedback.

42. A voltage regulator as in claim 41 in which said voltage to be used for feedback is divided to produce a control voltage which is equal to that voltage which causes a bipolar transistor to switch states when said voltage to be used for feedback is equal to said desired voltage, and said control voltage is applied across the base-emitter junction of said transistor.

43. A distributed display drive system for driving a matrix of display elements arranged in plurality of rows and columns, said system comprising:

means for driving the display elements in the plurality of columns;

means for driving the display elements in the plurality of rows;

means for generating at least one data signal and at least one control signal;

means for generating a row voltage between positive and negative row voltage nodes;

means for generating at a first column voltage node one and only one column voltage positive with respect to a reference voltage;

means for generating a second column voltage at a second column voltage node one and only one column voltage negative with respect to said reference voltage; and means for referencing either said reference voltage node, or said first column voltage node, or said second column voltage node to at least one data signal, or at least one control signal, or to at least one data signal and at least one control signal;

wherein said means for driving said plurality of columns is physically separate from said means for driving said plurality of rows.

44. A system of claim 43 wherein said means for generating a plurality of data signals and a plurality of control signals is integrated into a computer system.

45. A system of claim 44 wherein said computer system uses an MS DOS operating system.

46. A system of claim 43 wherein the absolute value of the difference between the most positive voltage and the most negative voltage applied to the means for driving the display elements in the plurality of columns is six volts or less.

47. A system of claim 43 wherein the absolute value of the difference between the most positive column voltage and the most negative column voltage is equal to the maximum voltage applied to said means for driving the display elements in the plurality of columns.

48. A system of claim 43 further including a switching regulator, wherein said first column voltage, said second column voltage, and said reference voltage are all generated directly by said switching regulator.

49. A system of claim 43 further including means for generating a phase signal, wherein a phase signal switches between first and second polarities every other row time at the end of a row time.

* * * * *